US012710210B2

(12) United States Patent
Lee et al.

(10) Patent No.: US 12,710,210 B2
(45) Date of Patent: Aug. 18, 2026

(54) REFRIGERATOR AND ICE MAKER

(71) Applicant: LG ELECTRONICS INC., Seoul (KR)

(72) Inventors: Donghoon Lee, Seoul (KR); Wookyong Lee, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 423 days.

(21) Appl. No.: 18/032,855

(22) PCT Filed: Oct. 18, 2021

(86) PCT No.: PCT/KR2021/014492
§ 371 (c)(1),
(2) Date: Jan. 29, 2024

(87) PCT Pub. No.: WO2022/086092
PCT Pub. Date: Apr. 28, 2022

(65) Prior Publication Data

US 2024/0384912 A1 Nov. 21, 2024

(30) Foreign Application Priority Data

Oct. 22, 2020 (KR) ..... 10-2020-0137635
Aug. 5, 2021 (KR) ..... 10-2021-0102874

(51) Int. Cl.
*F25C 1/243* (2018.01)
*F25C 1/25* (2018.01)

(52) U.S. Cl.
CPC ..... *F25C 1/243* (2013.01); *F25C 1/25* (2018.01); *F25C 2305/022* (2013.01); *F25C 2400/10* (2013.01); *F25C 2500/06* (2013.01)

(58) Field of Classification Search
CPC ..... F25C 1/243; F25C 1/25; F25C 2305/022; F25C 2400/10; F25C 2500/06; F25C 1/04;
(Continued)

(56) References Cited

U.S. PATENT DOCUMENTS 9,021,827 B2 5/2015 Lee
9,074,803 B2 7/2015 Culley
(Continued)

FOREIGN PATENT DOCUMENTS

CN 111197886 11/2011
CN 105466096 B 6/2018
(Continued)

OTHER PUBLICATIONS

KR 101643635 B1 Translation (Year: 2016).*
(Continued)

*Primary Examiner* — Jerry-Daryl Fletcher
*Assistant Examiner* — Dario Antonio Deleon
(74) *Attorney, Agent, or Firm* — KED & ASSOCIATES

(57) ABSTRACT

A refrigerator may include a cabinet, a door, and an ice maker. The ice maker may include a first tray; a first tray case; a second tray; and a second tray case. After supply of water to an ice-making cell while the second tray is at a water supply position, the second tray is to move in a first direction to an ice-making position. After generation of the ice while the second tray is at the ice-making position, the second tray is to move in a second direction so as to draw the ice out of the ice-making cell, and then the second tray is to move in the first direction to the water supply position. At the water supply position, the second tray is spaced from a portion of the first tray, and the first tray case includes a
(Continued)

water overflow prevention wall spaced apart from the first tray when the second tray is disposed at the water supply position.

19 Claims, 27 Drawing Sheets

(58) Field of Classification Search
CPC ..... F25C 5/04; F25C 5/22; F25D 2323/023; F25D 23/04
See application file for complete search history.

(56) References Cited

U.S. PATENT DOCUMENTS

| | | | | |
|---|---|---|---|---|
| 9,234,688 | B2 | 1/2016 | Son et al. | |
| 9,470,446 | B2 | 10/2016 | Yao et al. | |
| 2013/0014536 | A1 | 1/2013 | Son et al. | |
| 2013/0081412 | A1 | 4/2013 | Son et al. | |
| 2014/0182325 | A1* | 7/2014 | Lee | F25C 5/08 62/351 |
| 2019/0234668 | A1* | 8/2019 | Yeom et al. | F25C 5/08 |
| 2020/0158403 | A1 | 5/2020 | Hong et al. | |

FOREIGN PATENT DOCUMENTS

| | | | | |
|---|---|---|---|---|
| CN | 102242998 | | 5/2020 | |
| EP | 3653964 | | 5/2020 | |
| JP | S51-142149 | | 12/1976 | |
| JP | 01-230968 | | 9/1989 | |
| JP | 2011-012877 | | 1/2011 | |
| KR | 10-2011-0038370 | A | 4/2011 | |
| KR | 10-2013-0009332 | | 1/2013 | |
| KR | 10-2014-0122919 | A | 10/2014 | |
| KR | 10-1643635 | | 7/2016 | |
| KR | 101643635 | B1 * | 7/2016 | F25C 1/24 |
| KR | 10-2020-0057557 | A | 5/2020 | |
| KR | 10-2020-0057600 | A | 5/2020 | |
| KR | 10-2020-0084833 | | 7/2020 | |

OTHER PUBLICATIONS

International Search Report (with English Translation) and Written Opinion dated Jan. 20, 2022 issued in Application No. PCT/KR2021/014492.
Extended European Search Report dated Aug. 9, 2024 issued in Application No. 21883161.8.
Chinese Office Action dated Jul. 16, 2025.
European Search Report issued in Application No. 25210106.8 dated Jan. 2, 2026.
Korean Office Action issued in Application No. 10-2020-0137635 dated Mar. 17, 2026.

* cited by examiner

REFRIGERATOR AND ICE MAKER

CROSS-REFERENCE TO RELATED PATENT APPLICATIONS

This application is a U.S. National Stage Application under 35 U.S.C. § 371 of PCT Application No. PCT/KR2021/014492, filed Oct. 18, 2021, which claims priority to Korean Patent Application Nos. 10-2020-0137635, filed Oct. 22, 2020, and 10-2021-0102874, filed Aug. 5, 2021, whose entire disclosures are hereby incorporated by reference.

TECHNICAL FIELD

The present specification relates to a refrigerator and an ice maker.

BACKGROUND ART

In general, a refrigerator is a home appliance for storing foods in an internal storage space, which is shielded by a door, at a low temperature by low temperature air.

The refrigerator may cool the inside of the storage space by using cold air to store the stored food in a refrigerated or frozen state.

The refrigerator may be a side-by-side type refrigerator in which a freezing compartment and a refrigerating compartment are disposed at left and right sides, respectively, a top mount type refrigerator in which a freezing compartment is disposed above a refrigerating compartment, or a bottom freezer type refrigerator in which a refrigerating compartment is disposed above a freezing compartment.

In general, an ice maker for making ice is provided in a freezing compartment of a refrigerator. The ice maker makes ice by cooling water after accommodating the water supplied from a water supply source or a water tank into a tray. The ice made by the ice maker may be stored in the ice maker.

Ice stored in the ice bin may be discharged through a dispenser provided in a door, or a user may access the ice bin by opening a freezing compartment door and take out the ice from the ice bin.

An ice maker capable of making spherical ice is disclosed in Korean Patent Publication No. 10-2020-0057557, which is a prior art document.

The ice maker disclosed in the prior art document may be provided in a fixed state, for example, in a freezing compartment, and an ice bin for storing ice made in the ice maker is provided below the ice maker.

The ice maker includes an upper assembly and a lower assembly, and the lower assembly is rotatable relative to the upper assembly. In a process of supplying water, the lower assembly is rotated at a predetermined angle.

In the case of this prior art document, since the ice maker is provided in the freezing compartment, the user has to bend down to access the ice bin disposed in the freezing compartment after opening the freezing compartment door, and then take out the ice bin or take out the ice provided in the ice bin. Therefore, there is a disadvantage in that the user does not easily acquire the ice.

To easily acquire the ice, it may be considered to provide the ice maker and ice bin in the door. However, the prior art document does not suggest a technique for positioning the ice maker and the ice bin in the door and thus does not suggest a technique for preventing water existing in the ice maker from overflowing during the rotation of the door.

When the water in the ice maker overflows to drop into the ice bin, the ice stored in the ice bin becomes entangled with each other.

In particular, the technique for preventing the water from overflowing in the ice maker when the door is rotated while the lower assembly is rotated at a predetermined angle during the water supply process is not suggested.

Of course, in the case of the prior art document, the technique for preventing the water present in the ice maker from overflowing due to external vibration in a state in which the ice maker is installed in the freezing compartment is not suggested.

DISCLOSURE OF THE INVENTION

Technical Problem

The present embodiment provides a refrigerator, in which water supplied to an ice maker is provided from dropping toward an ice bin, and an ice maker.

Alternatively or additionally, the present embodiment provides a refrigerator, in which a pusher for separating ice smoothly passes through an opening while minimizing overflowing of water through the opening of an ice-making cell, and an ice maker.

Alternatively or additionally, the present embodiment provides a refrigerator, in which an ice maker configured to make spherical ice is provided in a door so that a user easily takes out ice, and an ice maker.

Technical Solution

An ice maker according to one aspect may include: a first tray configured to define a portion of an ice-making cell; a first tray case configured to support the first tray; a second tray configured to define the other portion of the ice-making cell and to be rotatable with respect to the first tray; and a second tray case configured to support the second tray.

After supply of water to the ice-making cell is completed at a water supply position, the second tray may move to an ice-making position in a forward direction. After the generation of the ice is completed at the ice-making position, the second tray may move in a reverse direction so as to draw the ice out of the ice-making cell, and then move in the forward direction to the water supply position.

The second tray may be spaced apart from at least a portion of the first tray at the water supply position.

The first tray case may include a water overflow prevention wall configured to surround the first tray in the state of being spaced apart from the first tray when the second tray is at the water supply position. When the second tray is at the water supply position, water supplied to the ice-making cell may be restricted to overflow through a gap between the first tray and the second tray by the water overflow prevention wall.

At the water supply position, a portion of the second tray may be disposed between the water overflow prevention wall and the first tray.

The water overflow prevention wall may include an inclined surface facing the first tray. The inclined surface may be inclined downward as it moves away from the first tray.

The second tray case may include a chamber wall configured to define a water accommodation chamber in which the water overflowing from the ice-making cell is accommodated.

At the water supply position, the water accommodation chamber and the water overflow prevention wall may be aligned in a vertical direction.

At an ice-making position, the water accommodation chamber may be covered by the water overflow prevention wall.

The first tray may include: an opening configured to communicate with the ice-making cell; a storage compartment wall configured to extend upward from a circumference of the opening; and a blocking wall provided on an upper end of the storage compartment wall.

The refrigerator may further include a pusher provided with a pushing bar that passes through the opening to easily separate the ice from being separated from the first tray. A through-hole through which the pushing bar passes may be defined in a central portion of the blocking wall.

The blocking wall may be made of a deformable material, and the through-hole may have a diameter less than that of the pushing bar.

The blocking wall may include a plurality of slits configured to extend from the through-hole in a radial direction.

The ice maker may be provided in a cabinet having a storage compartment or a door that opens and closes the storage compartment.

A refrigerator according to another aspect may include: a cabinet provided with a storage compartment; a door configured to open and close the storage compartment; and an ice maker disposed in the storage compartment or the door to generate ice.

The door may include an ice making chamber, and the ice maker may be disposed in the ice making chamber.

The ice maker may include: a first tray configured to define a portion of an ice-making cell; a first tray case configured to support the first tray; a second tray configured to define the other portion of the ice-making cell and to be rotatable with respect to the first tray; and a second tray case configured to support the second tray. After supply of water to the ice-making cell is completed at a water supply position, the second tray may move to an ice-making position in a forward direction, and after the generation of the ice is completed at the ice-making position, the second tray may move in a reverse direction so as to draw the ice out of the ice-making cell, and then move in the forward direction to the water supply position.

The first tray may include: an opening configured to communicate with the ice-making cell so as to provide a passage for cold air; a wall extending from a circumference of the opening; and a blocking wall provided on an upper end of the wall and having a through-hole.

The refrigerator may further include a pusher provided with a pushing bar that passes through the opening to easily separate the ice from being separated from the first tray. The pushing bar may pass through the through-hole of the blocking wall.

The blocking wall may be made of a deformable material, and the through-hole may have a diameter less than that of the pushing bar. The blocking wall may include a plurality of slits configured to extend from the through-hole in a radial direction.

A refrigerator according to further another aspect may include: a cabinet provided with a storage compartment; a door configured to open and close the storage compartment; and an ice maker provided in the door or the cabinet, wherein the ice maker includes: a first tray configured to define a portion of an ice-making cell; a first tray case configured to support the first tray; a second tray configured to define the other portion of the ice-making cell and to be rotatable with respect to the first tray; and a second tray case configured to support the second tray, wherein, after supply of water to the ice-making cell is completed at a water supply position, the second tray moves to an ice-making position in a forward direction, after the generation of the ice is completed at the ice-making position, the second tray moves in a reverse direction so as to draw the ice out of the ice-making cell, and then moves in the forward direction to the water supply position, and the first tray case comprises a water overflow prevention wall configured to surround the first tray in the state of being spaced apart from the first tray when the second tray is at the water supply position.

At the water supply position, a lower end of the water overflow prevention wall may be disposed higher than an upper end of the second tray.

At the water supply position, the upper end of the second tray may be disposed between the water overflow prevention wall and the first tray.

A portion of the second tray may be configured to surround an outer circumference of the second tray, and the water overflow prevention wall may include an inclined surface facing the first tray so that an interference between the second tray case and the water overflow prevention wall is prevented from occurring while the second tray moves from the water supply position to the ice-making position. The inclined surface may be inclined downward as it moves away from the first tray.

The second tray case may include a water accommodation chamber, and at the water supply position, the water accommodation chamber and the water overflow prevention wall may be aligned in a vertical direction.

The refrigerator may further include a door opening detection portion configured to detect an opening of the door.

When the second tray is at the water supply position, if the opening of the door is detected by the door opening detection portion, the second tray may move from the water supply position to the ice-making position.

When a closing of the door is detected by the door open detection portion, the second tray may move from the ice-making position to the water supply position.

An ice maker according to further another aspect may include: a first tray configured to define a portion of an ice-making cell; a second tray configured to define the other portion of the ice-making cell and be movable with respect to the first tray; and a tray case configured to support the second tray and include a chamber wall configured to define a water accommodation chamber in which water overflowing from the ice-making cell is accommodated.

After supply of water to the ice-making cell is completed at a water supply position, the second tray may move to the ice-making position to perform ice-making.

The tray case may include a circumferential wall configured to surround the second tray. The chamber wall may be configured to define the water accommodation chamber together with the circumferential wall.

The circumferential wall may include: a first circumferential wall; and a second circumferential wall disposed closer to a rotation center of the second tray than the first circumferential wall.

The chamber wall may be connected to the first circumferential wall.

The chamber wall may include: a first chamber wall spaced apart from the first circumferential wall; and second and third circumferential walls configured to extend from both ends of the first chamber wall in a direction crossing the first chamber wall and connected to the first circumferential wall.

A portion of the first circumferential wall may be rounded in a horizontal direction, and the chamber wall may have a height greater than a minimum distance between the first circumferential wall and the first chamber wall.

The first circumferential wall may have a height greater than that of the chamber wall.

The first circumferential wall may include: a vertical surface; and an inclined surface that is inclined from an upper end of the vertical surface. The inclined surface may be gradually inclined upward in a direction away from the first circumferential wall.

The refrigerator may further include an additional tray case configured to support the first tray. The additional tray case may include a barrier configured to cover the first tray in a state of being spaced apart from an outside of the first tray.

An upper end of the circumferential wall may be disposed between the barrier and the second tray when the second tray is at a water supply position.

The barrier may be vertically aligned with the water accommodation chamber when the second tray is at the water supply position.

When the second tray is at the ice-making position, the barrier may be configured to cover an upper side of the water accommodation chamber.

The second tray may be spaced apart from at least a portion of the first tray at the water supply position.

After the supply of water to the ice-making cell is completed at a water supply position, the second tray may move to an ice-making position in a forward direction. After the generation of the ice is completed at the ice-making position, the second tray may move in a reverse direction so as to draw the ice out of the ice-making cell, and then move in the forward direction to the water supply position.

A refrigerator according to further another aspect may include: a cabinet provided with a storage compartment; a door configured to open and close the storage compartment; and an ice maker provided in the door or the cabinet.

The ice maker may include: a first tray configured to define a portion of an ice-making cell; a second tray configured to define the other portion of the ice-making cell and to be rotatable with respect to the first tray; and a tray case configured to support the second tray.

After supply of water to the ice-making cell is completed at a water supply position, the second tray may move to an ice-making position in a forward direction.

After the generation of the ice is completed at the ice-making position, the second tray may move in a reverse direction so as to draw the ice out of the ice-making cell, and then move in the forward direction to the water supply position.

The tray case may include a water accommodation chamber in which the water overflowing from the ice-making cell is accommodated.

The tray case may include a circumferential wall configured to surround the second tray. The chamber wall may be configured to define the water accommodation chamber together with the circumferential wall.

The circumferential wall may include: a first circumferential wall; and a second circumferential wall disposed closer to a rotation center of the second tray than the first circumferential wall.

The chamber wall may be connected to the first circumferential wall.

The door may include an ice making chamber, and the ice maker may be disposed in the ice making chamber.

A refrigerator according to further another aspect may include: a cabinet provided with a storage compartment; a door configured to open and close the storage compartment; and an ice maker provided in the door or the cabinet and configured to make ice, wherein the ice maker includes: a first tray configured to define a portion of an ice-making cell; a second tray configured to define the other portion of the ice-making cell, the second tray having a portion that surrounds the first tray; and a tray case configured to support the second tray.

The tray case may include a chamber wall configured to define a water accommodation chamber in which water overflowing from the ice-making cell through a gap between the first tray and the second tray is accommodated.

The first tray may include an opening through which water is supplied.

The tray case may include a circumferential wall that surrounds a portion of the second tray, which surrounds the first tray, wherein the chamber wall may be configured to define the water accommodation chamber together with the circumferential wall.

The door may include an ice making chamber, and the ice maker may be disposed in the ice making chamber.

Advantageous Effects

According to the proposed embodiment, the water supplied to the ice maker may be prevented from overflowing and dropping downward due to rotation of the refrigerator door or the vibration of the refrigerator.

In addition, when the ice maker is installed at the door, the user may easily take out the ice from the ice bin.

In addition, according to the present embodiment, the pusher configured to separate the ice while minimizing the overflowing of the water through the opening of the ice-making cell may smoothly pass through the opening.

MODE FOR CARRYING OUT THE INVENTION

Figure 1:
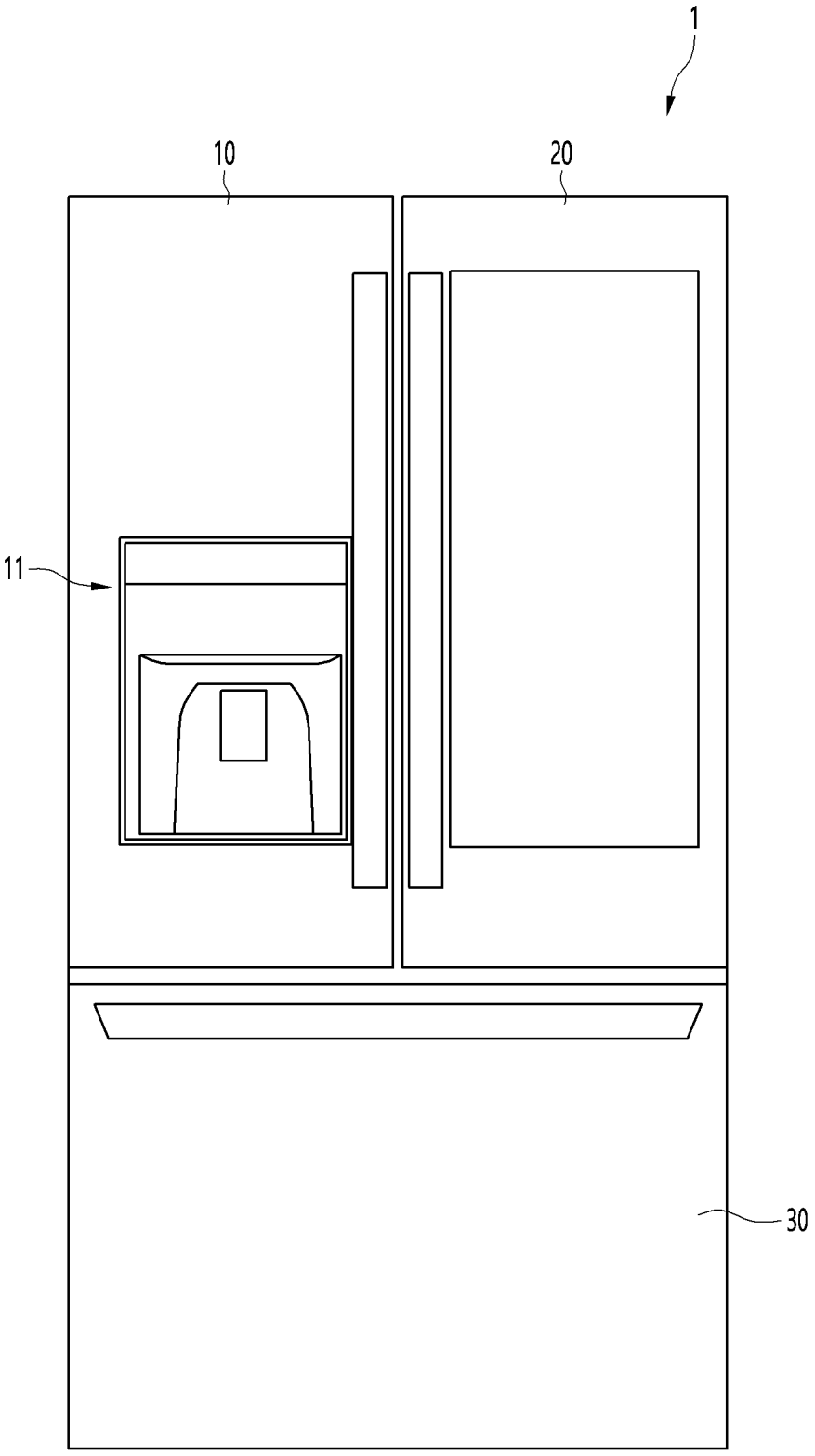
FIG. 1 is a front view of a refrigerator according to an embodiment of the present invention.

Hereinafter, some embodiments of the present invention will be described in detail with reference to the accompanying drawings. In adding reference numerals to components of each drawing, it should be noted that the same components have the same numerals as much as possible even if the components are displayed on different drawings. In addition, in describing the embodiments of the present invention, if it is determined that a detailed description of a related known configuration or function disturbs understanding of the embodiment of the present invention, the detailed description will be omitted.

Also, in the description of the embodiments of the present disclosure, the terms such as first, second, A, B, (a) and (b) may be used. These terms are only used to distinguish the component from other components, and the essence, sequence, or order of the corresponding component is not limited by the term. It should be understood that when an element is described as being "connected," "coupled", or "joined" to another element, the former may be directly connected, coupled or jointed to the latter or may be "connected", coupled" or "joined" to the latter with a third component interposed therebetween.

The refrigerator according to the present invention may include a tray assembly defining a portion of an ice-making cell that is a space in which water is phase-changed into ice, a cooler supplying cold air to the ice-making cell, a water supply portion supplying water to the ice-making cell, and a controller. The refrigerator may further include a temperature sensor detecting a temperature of water or ice of the ice-making cell. The refrigerator may further include a heater disposed adjacent to the tray assembly. The refrigerator may further include a driving portion to move the tray assembly. The refrigerator may further include a storage compartment in which food is stored in addition to the ice-making cell. The refrigerator may further include a cooler supplying cold air to the storage compartment. The refrigerator may further include a temperature sensor sensing a temperature in the storage compartment. The controller may control at least one of the water supply portion or the cooler. The controller may control at least one of the heater or the driver.

The controller may control the cooler so that cold air is supplied to the ice-making cell after moving the tray assembly to an ice-making position. The controller may control the second tray assembly so that the second tray assembly moves to an ice-separation position in a forward direction so as to take out the ice in the ice-making cell when the ice is completely made in the ice-making cell. The controller may control the tray assembly so that the supply of the water supply portion after the second tray assembly moves to the water supply position in the reverse direction when the ice is completely separated. The controller may control the tray assembly so as to move to the ice-making position after the water supply is completed.

According to the present invention, the storage compartment may be defined as a space that is controlled to a predetermined temperature by the cooler. An outer case may be defined as a wall that divides the storage compartment and an external space of the storage compartment (i.e., an external space of the refrigerator). An insulation material may be disposed between the outer case and the storage compartment. An inner case may be disposed between the insulation material and the storage compartment.

According to the present invention, the ice-making cell may be disposed in the storage compartment and may be defined as a space in which water is phase-changed into ice. A circumference of the ice-making cell refers to an outer surface of the ice-making cell irrespective of the shape of the ice-making cell. In another aspect, an outer circumferential surface of the ice-making cell may refer to an inner surface of the wall defining the ice-making cell. A center of the ice-making cell refers to a center of gravity or volume of the ice-making cell. The center may pass through a symmetry line of the ice-making cell.

According to the present invention, the tray may be defined as a wall partitioning the ice-making cell from the inside of the storage compartment. The tray may be defined as a wall defining at least a portion of the ice-making cell. The tray may be configured to surround the whole or a portion of the ice-making cell. The tray may include a first portion that defines at least a portion of the ice-making cell and a second portion extending from a predetermined point of the first portion. The tray may be provided in plurality. The plurality of trays may be in contact with each other. For example, the tray disposed at the lower portion may include a plurality of trays. The tray disposed at the upper portion may include a plurality of trays. The refrigerator may include at least one tray disposed under the ice-making cell. The refrigerator may further include a tray disposed above the ice-making cell. The first portion and the second portion may have a structure inconsideration of a heat transfer degree of the tray, a cold transfer degree of the tray, a degree of deformation resistance of the tray, a recovery degree of the tray, a supercooling degree of the tray, a degree of attachment between the tray and ice solidified in the tray, and coupling force between one tray and the other tray of the plurality of trays.

According to the present invention, the tray case may be disposed between the tray and the storage compartment. That is, the tray case may be disposed so that at least a portion thereof surrounds the tray. The tray case may be provided in plurality. The plurality of tray cases may be in contact with each other. The tray case may be in contact with the tray to support at least a portion of the tray. The tray case may be configured to connect components except for the tray (e.g., a heater, a sensor, a power transmission member, etc.). The tray case may be directly coupled to the component or coupled to the component via a medium therebetween. For example, if the wall defining the ice-making cell is provided as a thin film, and a structure surrounding the thin film is provided, the thin film may be defined as a tray, and the structure may be defined as a tray case. For another example, if a portion of the wall defining the ice-making cell is provided as a thin film, and a structure includes a first portion defining the other portion of the wall defining the ice-making cell and a second part surrounding the thin film, the thin film and the first portion of the structure are defined as trays, and the second portion of the structure is defined as a tray case.

According to the present invention, the tray assembly may be defined to include at least the tray. According to the present invention, the tray assembly may further include the tray case.

According to the present invention, the refrigerator may include at least one tray assembly connected to the driving portion to move. The driving portion is configured to move the tray assembly in at least one axial direction of the X, Y, or Z axis or to rotate about the axis of at least one of the X, Y, or Z axis. The present invention may include a refrigerator having the remaining configuration except for the driving portion and the power transmission member connecting the driving portion to the tray assembly in the contents described in the detailed description. According to the present invention, the tray assembly may move in a first direction.

According to the present invention, the cooler may be defined as a part configured to cool the storage compartment including at least one of an evaporator or a thermoelectric element.

According to the present invention, the refrigerator may include at least one tray assembly in which the heater is disposed. The heater may be disposed in the vicinity of the tray assembly to heat the ice-making cell defined by the tray assembly in which the heater is disposed. The heater may include a heater to be turned on in at least partial section while the cooler supplies cold air so that bubbles dissolved in the water within the ice-making cell moves from a portion, at which the ice is made, toward the water that is in a liquid state to make transparent ice. The heater may include a heater (hereinafter referred to as an "ice separation heater") controlled to be turned on in at least a section after the ice making is completed so that ice is easily separated from the tray assembly. The refrigerator may include a plurality of transparent ice heaters. The refrigerator may include a plurality of ice separation heaters. The refrigerator may include a transparent ice heater and an ice separation heater. In this case, the controller may control the ice separation heater so that a heating amount of ice separation heater is greater than that of transparent ice heater.

According to the present invention, the tray assembly may include a first region and a second region, which define an outer circumferential surface of the ice-making cell. The tray assembly may include a first portion that defines at least a portion of the ice-making cell and a second portion extending from a predetermined point of the first portion.

For example, the first region may be defined in the first portion of the tray assembly. The first and second regions may be defined in the first portion of the tray assembly. Each of the first and second regions may be a portion of the one tray assembly. The first and second regions may be disposed to contact each other. The first region may be a lower portion of the ice-making cell defined by the tray assembly. The second region may be an upper portion of an ice-making cell defined by the tray assembly. The refrigerator may include an additional tray assembly. One of the first and second regions may include a region contacting the additional tray assembly. When the additional tray assembly is disposed in a lower portion of the first region, the additional tray assembly may be in contact with the lower portion of the first region. When the additional tray assembly is disposed in an upper portion of the second region, the additional tray assembly and the upper portion of the second region may be in contact with each other.

For another example, the tray assembly may be provided in plurality contacting each other. The first region may be disposed in a first tray assembly of the plurality of tray assemblies, and the second region may be disposed in a second tray assembly. The first region may be the first tray assembly. The second region may be the second tray assembly. The first and second regions may be disposed to contact each other. At least a portion of the first tray assembly may be disposed under the ice-making cell defined by the first and second tray assemblies. At least a portion of the second tray assembly may be disposed above the ice-making cell defined by the first and second tray assemblies.

The first region may be a region closer to the heater than the second region. The first region may be a region in which the heater is disposed. The second region may be a region closer to a heat absorbing part (i.e., a coolant pipe or a heat absorbing part of a thermoelectric module) of the cooler than the first region. The second region may be a region closer to the through-hole supplying cold air to the ice-making cell than the first region. To allow the cooler to supply the cold air through the through-hole, an additional through-hole may be defined in another component. The second region may be a region closer to the additional through-hole than the first region. The heater may be a transparent ice heater. The heat insulation degree of the second region with respect to the cold air may be less than that of the first region.

The heater may be disposed in one of the first and second tray assemblies of the refrigerator. For example, when the heater is not disposed on the other one, the controller may control the heater to be turned on in at least a sections of the cooler to supply the cold air. For another example, when the additional heater is disposed on the other one, the controller may control the heater so that the heating amount of heater is greater than that of additional heater in at least a section of the cooler to supply the cold air. The heater may be a transparent ice heater.

The present invention may include a refrigerator having a configuration excluding the transparent ice heater in the contents described in the detailed description.

The present invention may include a pusher having a first edge having a surface pressing the ice or at least one surface of the tray assembly so that the ice is easily separated from the tray assembly. The pusher may include a bar extending from the first edge and a second edge disposed at an end of the bar. The controller may control the pusher so that a position of the pusher is changed by moving at least one of the pusher or the tray assembly. The pusher may be defined as a through pusher, a non-penetrating pusher, a movable pusher, or a fixed pusher according to a view point.

The through-hole through which the pusher moves may be defined in the tray assembly, and the pusher may be configured to directly press the ice in the tray assembly. The pusher may be defined as a through pusher.

The tray assembly may be provided with a pressing part pressing the pusher, the pusher may be configured to apply a pressure to one surface of the tray assembly. The pusher may be defined as a non-penetrating pusher.

The controller may control the pusher to move so that the first edge of the pusher is disposed between a first point outside the ice-making cell and a second point inside the ice-making cell.

The pusher may be defined as a movable pusher. The pusher may be connected to a driver, the rotation shaft of the driver, or the tray assembly that is connected to the driving portion and is movable.

The controller may control the pusher to move at least one of the tray assemblies so that the first edge of the pusher is disposed between the first point outside the ice-making cell and the second point inside the ice-making cell. The controller may control at least one of the tray assemblies to move to the pusher. Alternatively, the controller may control a relative position of the pusher and the tray assembly so that the pusher further presses the pressing part after contacting the pressing part at the first point outside the ice-making cell. The pusher may be coupled to a fixed end. The pusher may be defined as a fixed pusher.

According to the present invention, the ice-making cell may be cooled by the cooler cooling the storage compartment. For example, the storage compartment in which the ice-making cell is disposed may be a freezing compartment which is controlled at a temperature lower than 0 degree, and the ice-making cell may be cooled by the cooler cooling the freezing compartment.

The freezing compartment may be divided into a plurality of regions, and the ice-making cell may be disposed in one region of the plurality of regions.

According to the present invention, the ice-making cell may be cooled by a cooler other than the cooler cooling the storage compartment. For example, the storage compartment in which the ice-making cell is disposed is a refrigerating compartment which is controlled to a temperature higher than 0 degree, and the ice-making cell may be cooled by a cooler other than the cooler cooling the refrigerating compartment. That is, the refrigerator may include a refrigerating compartment and a freezing compartment, the ice-making cell may be disposed inside the refrigerating compartment, and the ice maker cell may be cooled by the cooler that cools the freezing compartment.

The ice-making cell may be disposed in a door that opens and closes the storage compartment.

According to the present invention, the ice-making cell is not disposed inside the storage compartment and may be cooled by the cooler. For example, the entire storage compartment defined inside the outer case may be the ice-making cell.

Figure 2:
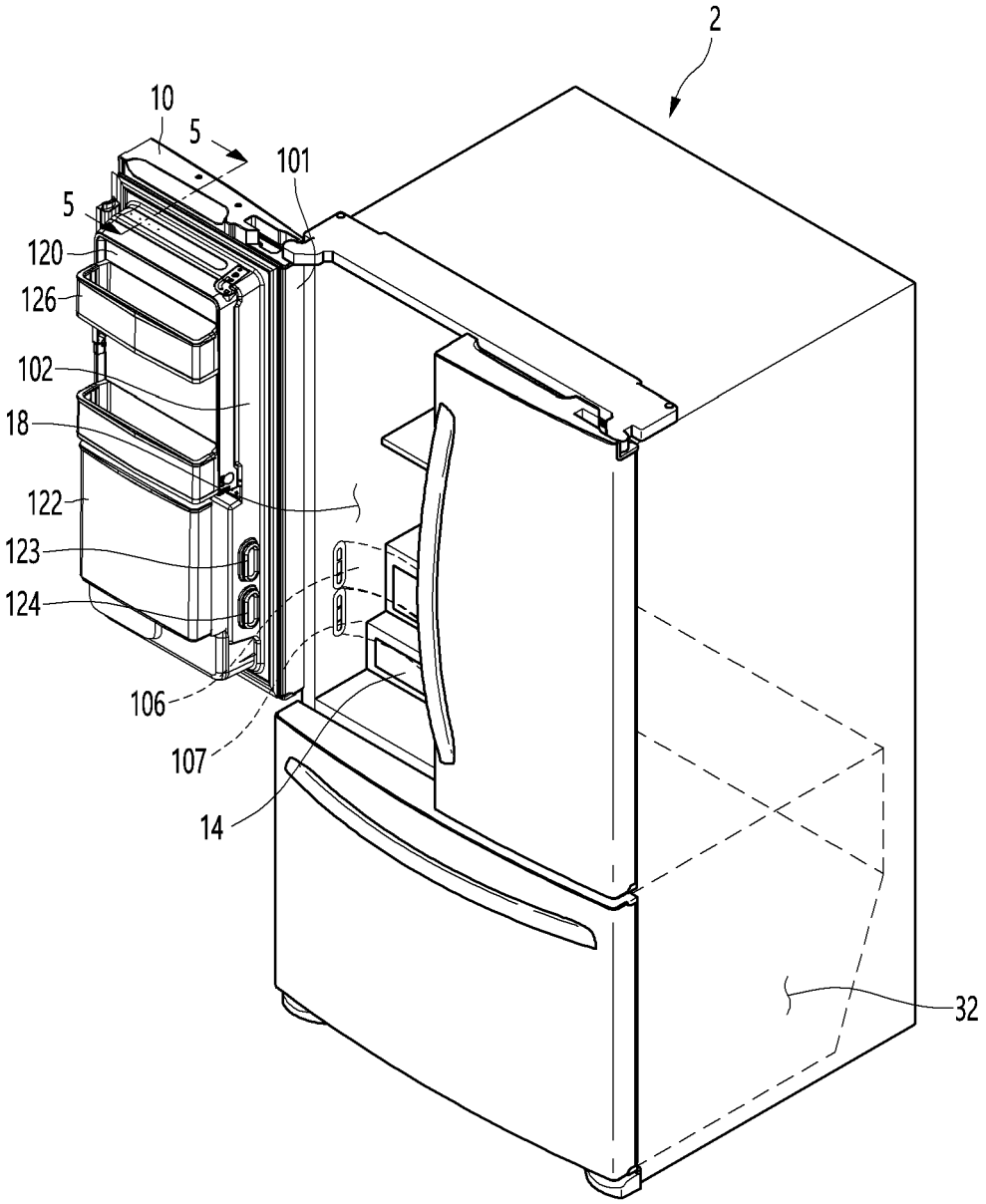
FIG. 2 is a view illustrating a state in which one door of the refrigerator of FIG. 1 is opened.

FIG. 1 is a front view of a refrigerator according to an embodiment of the present invention, and FIG. 2 is a view illustrating a state in which one door of the refrigerator of FIG. 1 is opened.

Figure 3:
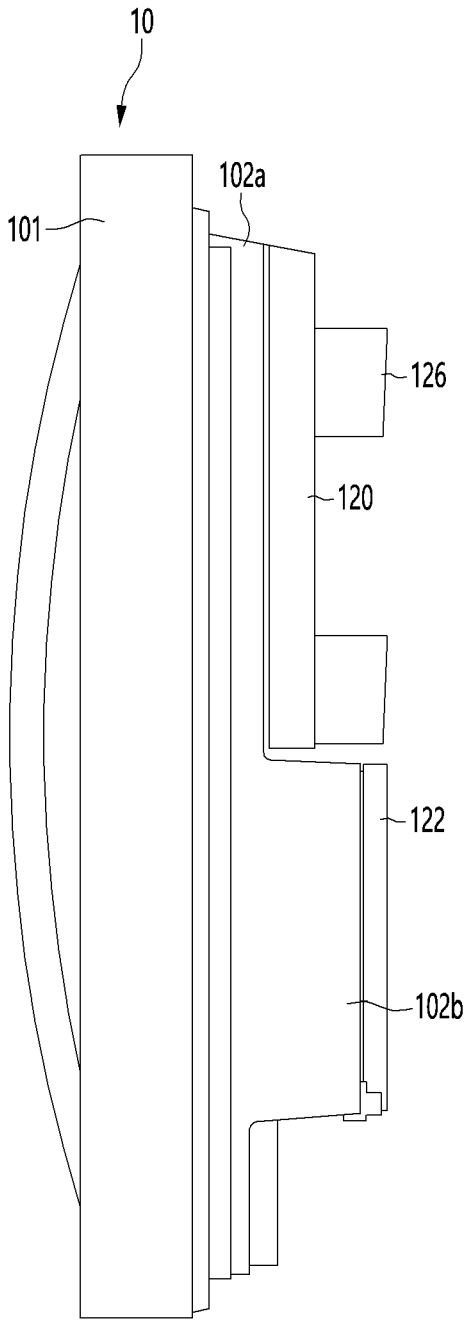
FIG. 3 is a side view of a refrigerating compartment door according to an embodiment of the present invention.
Figure 4:
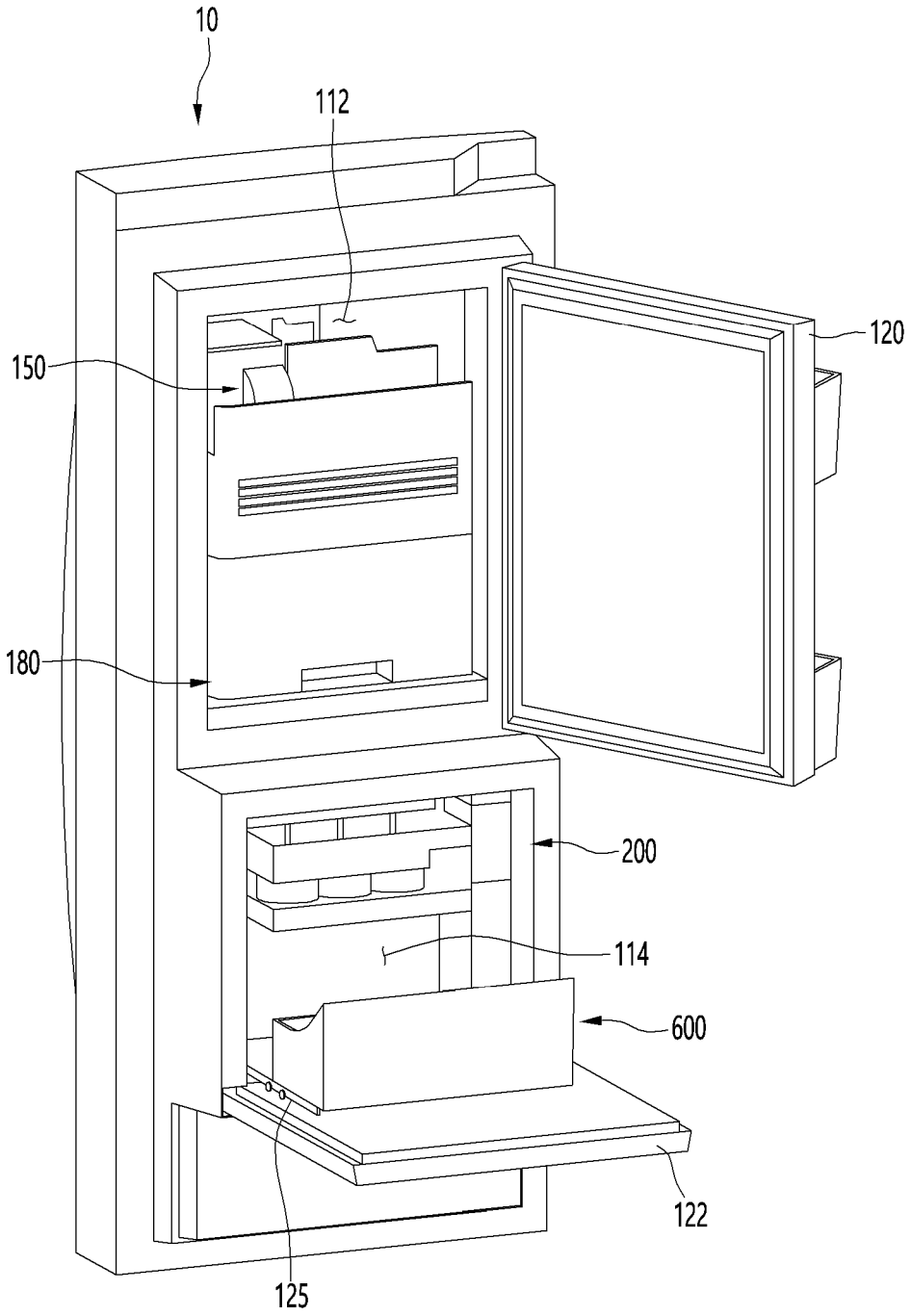
FIG. 4 is a view illustrating a state in which a plurality of ice-making chambers of the refrigerating compartment door are opened.
Figure 5:
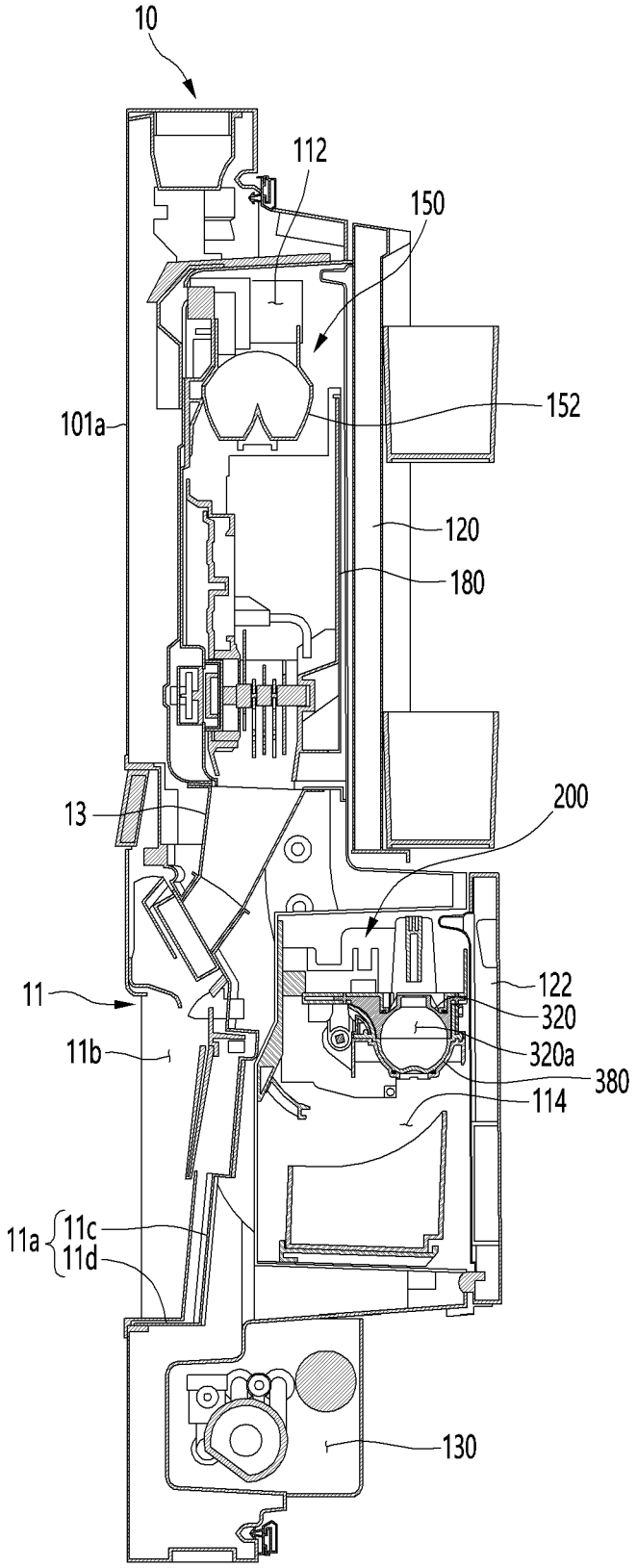
FIG. 5 is a cross-sectional view taken along line 5-5 of FIG. 2.

FIG. 3 is a side view of a refrigerating compartment door according to an embodiment of the present invention, FIG. 4 is a view illustrating a state in which a plurality of ice-making chambers of the refrigerating compartment door are opened, and FIG. 5 is a cross-sectional view taken along line 5-5 of FIG. 2.

Referring to FIGS. 1 to 5, a refrigerator 1 according to the present embodiment may include a cabinet 2 having a storage compartment (or storage space) and a door that opens and closes the storage compartment.

The storage space may include a refrigerating compartment 18 and a freezing compartment 32, which is disposed below the refrigerating compartment 18.

The refrigerating compartment 18 may be opened and closed by one or more refrigerating compartment doors 10 and 20, and the freezing compartment 32 may be opened and closed by one or more freezing compartment doors 30. For example, the refrigerating compartment 18 may be opened and closed by a first refrigerating compartment door 10 and a second refrigerating compartment door 20.

One or more refrigerating compartment doors 10 and 20 may include a plurality of ice makers 150 and 200. As an example, FIG. 5 illustrates that the first refrigerating compartment door 10 includes a plurality of ice makers 150 and 200. However, it is not limited thereto, and the second refrigerating compartment door 20 may include a plurality of ice makers 150 and 200.

Although a bottom freezer type refrigerator is exemplarily illustrated in FIG. 2, unlike this, it is revealed that the spirit of the present invention may be equally applied to a side-by-side type refrigerator or a top mount type refrigerator.

In the case of the side-by-side or top mount type refrigerator, the freezing compartment door may include a plurality of ice makers, or the refrigerating compartment door may include a plurality of ice makers.

Hereinafter, for convenience of description, it is referred to as "the refrigerator compartment door 10 including the plurality of ice makers 150 and 200".

The refrigerating compartment door 10 may include a dispenser 11 configured to dispense ice made in at least one of the plurality of ice makers 150 and 200.

The dispenser 11 is disposed in front of the refrigerating compartment door 10, and a portion of the dispenser 11 is recessed backward to provide a space in which a container is capable of being placed.

The plurality of ice makers 150 and 200 may be arranged in a vertical direction. For example, the plurality of ice makers 150 and 200 may include a first ice maker 150 and a second ice maker 200 disposed below the first ice maker 150. Of course, the present embodiment does not exclude that the plurality of ice makers 150 and 200 are disposed in a lateral direction.

The dispenser 11 may dispense ice made in at least the first ice maker 150. Thus, the first ice maker 150 may be disposed higher than the dispenser 11. When the dispenser 11 dispenses the ice made in the second ice maker 200, the second ice maker 200 may also be disposed higher than the dispenser 11.

The refrigerator compartment door 10 may include an outer case 101 configured to define an outer appearance of a front surface thereof and a door liner 102 coupled to the outer case 101. The door liner 102 may open and close the refrigerating compartment 18.

In a state in which the outer case 101 and the door liner 102 are coupled to each other, a heat insulation space may be defined in a space between the outer case 101 and the door liner 102, and a heat insulating material may be provided in the heat insulation space.

The door liner 102 may define a plurality of ice-making chambers 112 and 114 in which the plurality of ice makers 150 and 200 are disposed.

The plurality of ice-making chambers 112 and 114 may be provided in such a manner that one surface of the door liner 102 is recessed toward the outer case 101. The plurality of ice-making chambers 112 and 114 may include a first ice-making chamber 112 in which the first ice maker 150 is accommodated and a second ice-making chamber 114 in which the second ice maker 200 is accommodated.

The plurality of ice-making chambers 112 and 114 may be arranged in the vertical direction or in the lateral direction. As an example, FIG. 5 illustrates that the plurality of ice-making chambers 112 and 114 are arranged in the vertical direction.

The refrigerator compartment door 10 may further include a first ice bin 180 in which the ice made by the first ice maker 150 is stored and a second ice bin 600 in which the ice made by the second ice maker 200 is stored.

The first ice bin 180 may be accommodated in the first ice-making chamber 112 together with the first ice maker 150. The second ice bin 600 may be accommodated in the second ice-making chamber 114 together with the second ice maker 200.

Cold generated by a cooler may be supplied to the ice-making chambers 112 and 114. For example, cold air for cooling the freezing compartment 32 may be supplied to the ice-making chambers 112 and 114.

Thus, the refrigerator 1 may include: a supply passage 106 to guide cold air in the freezing compartment or cold air in a space, in which an evaporator generating cold air for cooling the freezing compartment 32 is disposed, to the refrigerating compartment door 10 and a discharge passage 107 to guide cold air discharged from the refrigerating compartment door 10 to the freezing compartment 32 or the space in which the evaporator is disposed.

The refrigerator compartment door 10 may include a cold air inlet 123 and a cold air outlet 124. When the refrigerating compartment door 10 is closed, the cold air inlet 123 may communicate with the supply passage 106, and the cold air outlet 124 may communicate with the discharge passage 107.

The cold air inlet 123 and the cold air outlet 124 may be provided in a side surface of the door liner 102. Although not limited, the side surface of the door liner 102 may be a surface facing a wall of the refrigerating compartment 18, in which the supply passage 106 and the discharge passage 107 are disposed when the refrigerating compartment door 10 is closed.

A shape of ice made in the first ice maker 150 may be different from that of ice made in the second ice maker 200. For example, the second ice maker 200 may make spherical ice.

In the present specification, the "spherical shape" refers to a geometrically spherical shape as well as a shape similar to a spherical shape.

In addition, transparency of the ice made in the first ice maker 150 may be different from that of the ice made in the second ice maker 200. For example, the transparency of ice made in the second ice maker 200 may be higher than that of ice made in the first ice maker 150.

A size (or volume) of the ice made in the first ice maker 150 and a size (or volume) of the ice made in the second ice maker 200 may be different from each other. For example, the size (or volume) of the ice made in the second ice maker 200 may be greater than that of the size (or volume) of the ice made in the first ice maker 150.

A structure of the first ice maker 150 for making ice and a manner for separating the made ice may be different from a structure of the second ice maker 200 and a manner for separating the made ice in the second ice maker 200.

Due to the difference in structure and ice-separation manner, a shape of the first ice-making chamber 112 in which the first ice maker 150 is disposed is different from that of the second ice-making chamber 114 in which the second ice maker 200 is disposed. For example, a depth of the second ice-making chamber 114 may be greater than that of the first ice-making chamber 112.

Due to the depth difference between the ice-making chambers 112 and 114, the side surface of the door liner 102 may include a first side surface portion 102*a* and a second side surface portion 102*b* that have different widths in a front to rear direction.

A width of the second side surface portion 102*b* may be larger than that of the second side surface portion 102*a*. Due to the difference in width between the side surface portions 102*b*, a thickness of the refrigerating compartment door 10 at a portion at which the second ice maker 200 is disposed is greater than that of the refrigerating compartment door 10 in the front to rear direction at a portion at which the first ice maker 150 is disposed.

The cold air inlet 123 and the cold air outlet 124 may be provided in the second side surface portion 102*b* of the door liner 102.

For example, referring to FIGS. 2 and 3, the second side surface portion 102*b* may protrude further toward the refrigerating compartment 18 than the first side surface portion 103*a*.

Since the refrigerator compartment door 10 defines the ice-making chambers 112 and 114, the refrigerator compartment door 10 may further include a plurality of ice-making chamber doors 120 and 122 that open and close the plurality of ice-making chambers 112 and 114 to thermally insulate the ice-making chambers 112 and 114, respectively.

The plurality of ice-making chamber doors 120 and 122 may include a first ice-making chamber door 120 that opens and closes the first ice-making chamber 112 and a second ice-making chamber door 122 that opens and closes the second ice-making chamber 114.

The plurality of ice-making chamber doors 120 and 122 may partition the ice-making chambers 112 and 114 from the refrigerating compartment 18. Each of the plurality of ice-making chamber doors 120 and 122 may include a heat insulating material. Thus, heat transfer between the refrigerating compartment 18 and the ice-making chambers 112 and 114 may be minimized by the plurality of ice-making chamber doors 120 and 122.

Each of the ice-making chamber doors 120 and 122 may be rotatably connected to the refrigerating compartment door 10 by, for example, a hinge.

However, rotational directions of the first ice-making chamber door 120 and the rotational direction of the second ice-making chamber door 122 may be different from each other. For example, the first ice-making chamber door 120 may be rotated based on a rotation center extending in a first direction, and the second ice-making chamber door 122 may be rotated based on a rotation center extending in a second direction crossing the first direction. Although not limited, the first direction may be a vertical direction, and the second direction may be a horizontal direction.

When the rotation center of the second ice-making chamber door 122 extends in the horizontal direction, the rotation center of the second ice-making chamber door 122 may be provided by the hinge disposed on a lower portion of a side surface of the second ice-making chamber door 120. Thus, an upper side of the second ice-making chamber door 122 may be rotated with respect to the hinge disposed at a lower side.

The refrigerator compartment door 10 may further include a draw-out unit 125 configured to draw at least a portion of the second ice bin 600 out of the second ice-making chamber 122 while the second ice-making chamber door 122 is opened.

One side of the draw-out unit 125 may be connected to the second ice-making chamber door 122, and the other side may be directly or indirectly connected to the second ice bin 600. For example, the draw-out unit 125 may include one or more links. When the second ice-making chamber door 122 is opened, the second ice bin 600 may be disposed above the second ice-making chamber door 122. For example, the second ice bin 600 may be directly or indirectly supported by the second ice-making chamber door 122.

A basket 126 capable of storing food may be connected to the first ice-making chamber door 120 due to the difference in thickness of the refrigerating compartment door 10.

In case of the present embodiment, since the rotation center of the first ice-making chamber door 120 extends in the vertical direction, the first ice-making chamber door 120 is rotatable in the horizontal direction. Therefore, while the first ice-making chamber door 120 is rotated, the food may be stably stored in the basket 126.

Referring to FIG. 3, in a state where the basket 126 is installed on the first ice-making chamber door 120, at least a portion of the basket 126 may overlap the second ice-making chamber 114 in the vertical direction. In the state where the basket 126 is installed on the first ice-making chamber door 120, at least a portion of the basket 126 may overlap the second ice maker 120 in the vertical direction. In the state where the basket 126 is installed on the first ice-making chamber door 120, and the second ice-making chamber door 122 is closed, at least a portion of the basket 126 may overlap the second ice bin 600 in the vertical direction. In the state where the basket 126 is installed on the first ice-making chamber door 120, and the second ice-making chamber door 122 is closed, at least a portion of the basket 126 may overlap the second ice-making chamber door 122 in the vertical direction.

Referring to FIG. 5, the first ice maker 150 may include an ice tray 152 defining the ice-making cell.

The first ice maker 150 may further include a driving portion that provides power to automatically rotate the ice tray 152 so as to separate ice from the ice tray 152, and a power transmission portion that transmits the power of the driving portion 158 to the ice tray 152.

The ice tray 152 may include a plurality of ice-making cells, and water discharged from the water supply portion 156 to drop into the ice tray 152 may be distributed to the plurality of ice-making cells.

The second ice maker 200 may include a first tray 320 and a second tray 380. Each of the first tray 320 and the second tray 380 may define an ice-making cell 320*a*. The second tray 380 may be rotated with respect to the first tray 320.

Water may be supplied to the second tray 380 when the second tray 380 is at a water supply position, and after the water supply is completed, the second tray 380 may be rotated to an ice-making position. At least a portion of the second tray 380 may be spaced apart from at least a portion of the first tray 320 at the water supply position. The portion of the second tray 380, which is spaced apart from the first tray 320, at the water supply position, may be in contact with the first tray 320 at the ice-making position to completely define the ice-making cell 320*a*.

The dispenser 11 may include a dispenser housing 11*a* defining a cavity 11*b*. The dispenser housing 11*a* may be coupled to, for example, the outer case 101. The cavity 11*b* may be recessed backward from a front surface 101*a* of the refrigerator door 10.

At least a portion of the dispenser 11 may be disposed to overlap the second ice-making chamber 114 in the front and rear direction. For example, at least a portion of the second ice-making chamber 114 may be disposed between a recessed wall 11*c* of the dispenser housing 11*a* and the second ice-making chamber door 122.

The shortest horizontal distance between the front surface 101*a* of the refrigerator door 10 and the second ice-making chamber 112 may be greater than the shortest horizontal distance between the front surface 101*a* of the refrigerator door 10 and the first ice-making chamber 112 by the dispenser housing 11*a*. A width (or depth) of the first ice-making chamber 112 in the front to rear direction may be less than a width (or depth) of the second ice-making chamber 114 in the front to rear direction.

A vertical length of the first ice-making chamber 112 may be greater than a vertical length of the second ice-making chamber 114. At least a portion of the second ice-making chamber 114 may overlap the first ice-making chamber 112 in the vertical direction. In addition, at least portions of the first ice-making chamber 112, the second ice-making chamber 114, and the accommodation chamber 130 may overlap each other in the vertical direction.

An ice chute 13 may be disposed below the first ice-making chamber 112. The ice chute 13 may guide the ice discharged from the first ice bin 180 to the dispenser 11. The ice chute 13 may overlap at least a portion of the first ice-making chamber 112 in the vertical direction. At least a portion of the ice chute 13 may overlap the second ice-making chamber 114 in the vertical direction.

At least a portion of the ice chute 13 may overlap the accommodation chamber 130 in the vertical direction. A vertical center line of the ice-making cell 320*a* of the second ice maker 200 may not pass through the first ice-making chamber 112 at the ice-making position of the second tray 380. The vertical center line of the ice cell 320*a* of the second ice maker 200 may be disposed outside the first ice-making chamber 112.

The ice-making cell 320*a* of the second ice-maker 200 may be disposed so as not to overlap the first ice-making chamber 112 in the vertical direction at the ice-making position of the second tray 380. The ice-making cell 320*a* of the second ice maker 200 may overlap the basket 126 in the vertical direction.

The vertical center line of the ice-making cell 320*a* of the second ice maker 200 may not pass through the accommodation chamber 130 at the ice-making position of the second tray 380. The ice-making cell 320*a* of the second ice maker 200 may be disposed so as not to overlap the accommodation chamber 130 in the vertical direction. That is, the vertical center line of the ice-making cell 320*a* of the second ice maker 200 may be disposed outside the accommodation chamber 130.

The ice-making cell 320*a* may be disposed lower than the ice chute 13 and higher than a bottom wall 11*d* of the dispenser housing 11*a* at the ice-making position of the second tray 380. Here, the ice-making cell 320*a* may be disposed closer to the ice chute 13 than the bottom wall 11*d* of the dispenser housing 11*a*.

The second tray 380 may overlap at least a portion of the first ice-making chamber 112 in the vertical direction at the ice-separation position of the second tray 380. The second tray 380 may overlap at least a portion of the accommodation chamber 130 in the vertical direction at the ice-separation position of the second tray 380. At least a portion of the second tray 380 may overlap the ice chute 13 in the vertical direction at the ice-separation position of the second tray 380.

In the above description, although it has been described that the first ice maker 150 and the second ice maker 200 are provided in the refrigerator door, the first ice maker 150 may be omitted, and only the second ice maker 200 may be provided in the refrigerator door.

Figure 6:
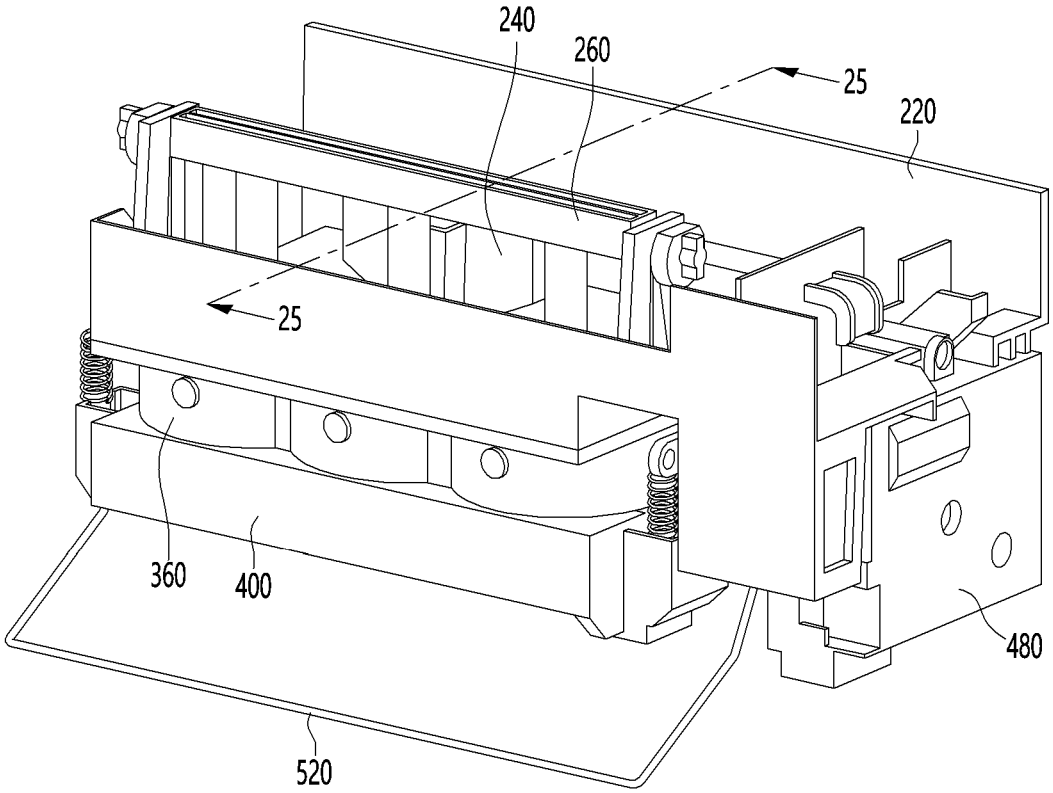
FIG. 6 is a perspective view of a second ice maker according to an embodiment of the present invention.
Figure 7:
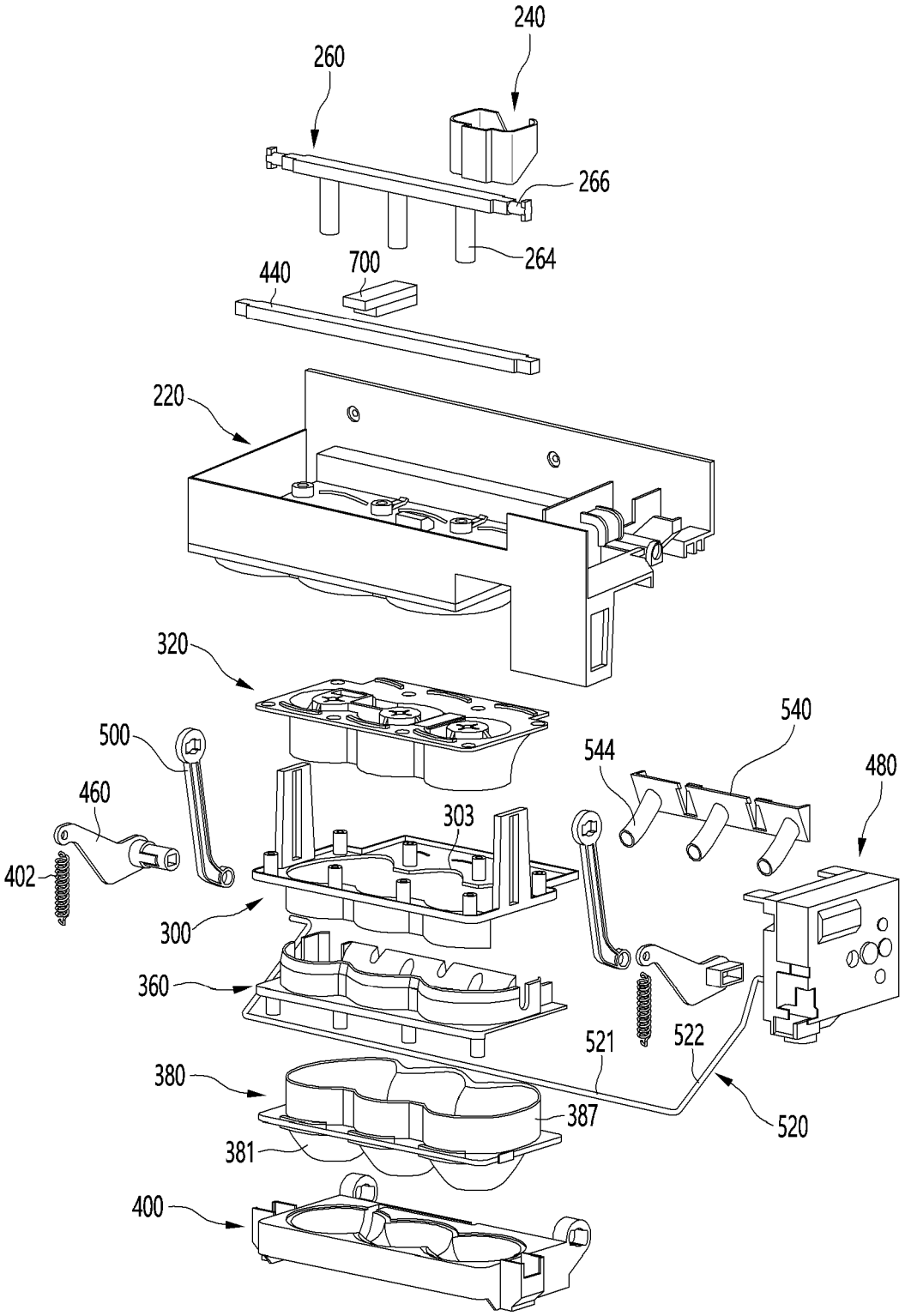
FIG. 7 is an exploded perspective view of the second ice maker of FIG. 5.
Figure 8:
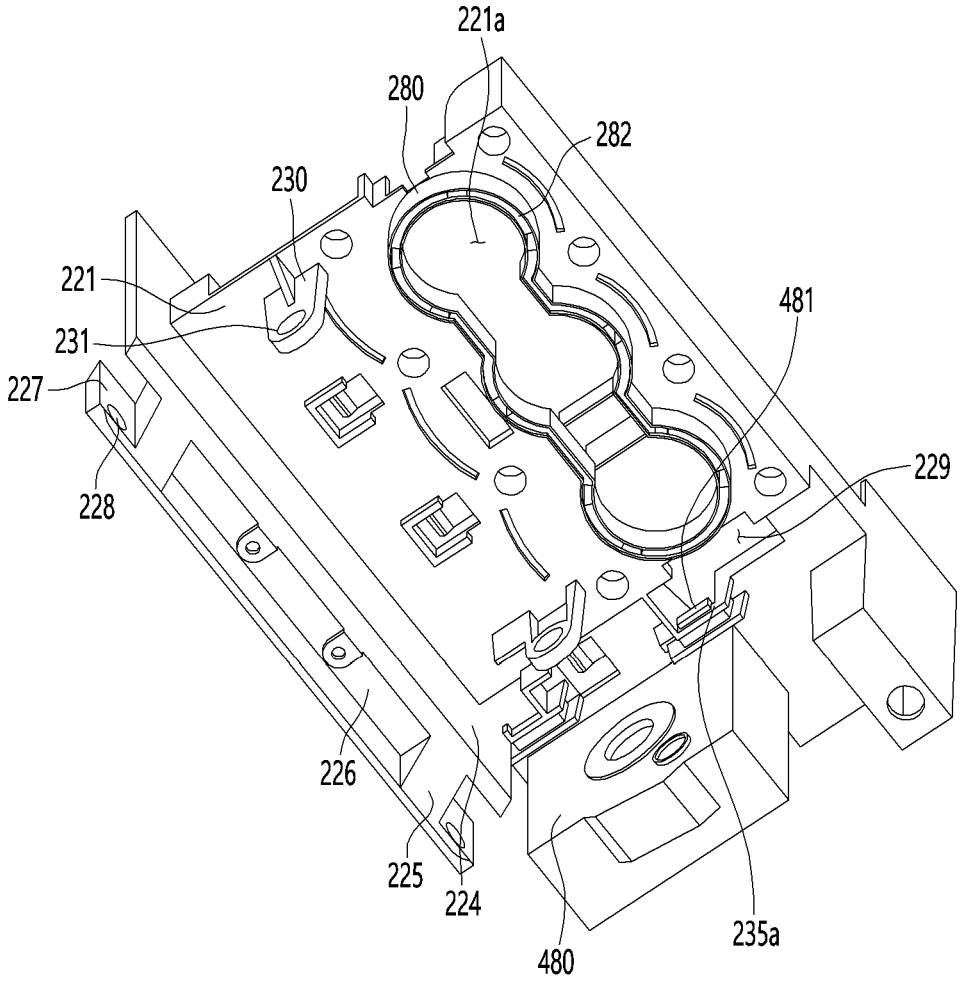
FIG. 8 is a bottom perspective view illustrating a state in which a driving portion is coupled to a bracket according to an embodiment of the present invention.

FIG. 6 is a perspective view of the second ice maker according to an embodiment of the present invention, and FIG. 7 is an explode perspective view of the second ice maker of FIG. 5. FIG. 8 is a bottom perspective view illustrating a state in which the driving portion is coupled to a bracket according to an embodiment of the present invention.

Referring to FIGS. 5 to 8, the second ice maker 200 may include a first tray assembly and a second tray assembly.

The first tray assembly may include one of a first tray 320 and a first tray case, or include both the first tray 320 and a first tray case. The second tray assembly may include one of a second tray 380 and a second tray case, or include both the second tray 380 and a second tray case.

The second ice maker 200 may include a bracket 220. Each of components of the second ice maker 200 may be provided inside or outside the bracket 220, and thus, the second ice maker 200 may constitute one assembly. The bracket 220 may be one component of the first tray assembly. The bracket 220 may be one component of the first tray case. For example, the bracket 220 may be installed on a wall defining the second ice-making chamber 114.

The bracket 220 may be provided with a water supply portion 240. The water supply portion 240 may guide water supplied from the upper side to the lower side of the water supply portion 240.

The second ice maker 200 may include an ice-making cell 320*a* in which water is phase-changed into ice by the cold (e.g., the cold air). The first tray 320 may form at least a portion of the ice-making cell 320*a*. The second tray 380 may form the other portion of the ice-making cell 320*a*.

The second tray 380 may be disposed to be relatively movable with respect to the first tray 320. The second tray 380 may linearly move or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 are in contact with each other, the complete ice-making cell 320*a* may be defined. On the other hand, the second tray 380 may move with respect to the first tray 320 to be spaced apart from the first tray 320, during the ice separation process after the ice making is completed.

In the present embodiment, the first tray 320 and the second tray 380 may be arranged in a vertical direction in a state where the ice-making cell 320*a* is defined. Accordingly, the first tray 320 may be referred to as an upper tray, and the second tray 380 may be referred to as a lower tray.

A plurality of ice-making cells 320*a* may be defined by the first tray 320 and the second tray 380. In the present embodiment, a structure in which three ice-making cells 320*a* are provided will be described as an example.

When water is cooled by cold air while water is supplied to the ice-making cell 320*a*, ice having the same or similar shape as that of the ice-making cell 320*a* may be made. In the present embodiment, for example, the ice-making cell 320*a* may be provided in a spherical shape or a shape similar to a spherical shape. The ice-making cell 320*a* may have a rectangular parallelepiped shape or a polygonal shape.

For example, the first tray case may include the first tray supporter 300 and the first tray cover 221. The first tray supporter 300 and the first tray cover 221 may be integrally formed with or coupled to each other after being manufactured in separate configurations. For example, at least a portion of the first tray cover 221 may be disposed above the first tray 320. At least a portion of the first tray supporter 300 may be disposed under the first tray 320. The first tray cover 221 may be integrated with the bracket 220. That is, the bracket 220 may include the first tray cover 221.

The second ice maker 200 may include a first pusher 260 separating the ice during an ice separation process. The first pusher 260 may receive power of the driving portion 480 to be described later.

A guide protrusion 266 of the first pusher 260 may be inserted into the first tray supporter 300. In this state, the first tray supporter 300 guides vertical movement of the first pusher 260. The first tray supporter 300 may include an opening 301*a*. The first tray 320 may pass through the opening 301*a*.

The first pusher 260 may include at least one pushing bar 264. For example, the first pusher 260 may include a pushing bar 264 provided with the same number as the number of ice-making cells 320*a*, but is not limited thereto.

The pushing bar 264 may push out the ice disposed in the ice-making cell 320*a* during the ice separation process. For example, the pushing bar 264 may be inserted into the ice-making cell 320*a* through the first tray cover 221. Thus, the first tray cover 221 may be provided with an opening 221*a* (or through-hole) through which a portion of the first pusher 260 passes.

The first pusher 260 may be coupled to a pusher link 500. In this case, the first pusher 260 may be rotatably coupled to the pusher link 500. Therefore, when the pusher link 500 moves, the first pusher 260 may also be guided by the first tray supporter 300 to move.

The second tray case may include, for example, a second tray cover 360 and a second tray supporter 400. The second tray cover 360 and the second tray supporter 400 may be integrally formed with or coupled to each other after being manufactured in separate configurations. For example, at least a portion of the second tray cover 360 may be disposed above the second tray 380. At least a portion of the second tray supporter 400 may be disposed below the second tray 380.

The second tray supporter 400 may be disposed at a lower side of the second tray to support the second tray 380. For example, at least a portion of the wall defining a second cell 381*a* (see FIG. 18) of the second tray 380 may be supported by the second tray supporter 400.

An elastic member 402 may be connected to one side of the second tray supporter 400. The elastic member 402 may provide elastic force to the second tray supporter 400 to maintain a state where the second tray 380 contacts the first tray 320.

The second tray 380 may include a barrier 387 surrounding a portion of the first tray 320 in a state of contacting the first tray 320. The second tray cover 360 may cover at least a portion of the barrier 387.

A transparent ice heater 430 to be described later may be installed in the second tray supporter 400. The transparent ice heater 430 may provide heat to the second tray 380 during at least the ice separation process.

The second ice maker 200 may further include a driving portion 480 that provides driving force. The second tray 380 may relatively move with respect to the first tray 320 by receiving the driving force from the driving portion 480. The first pusher 260 may move by receiving the driving force from the driving force 480.

A through-hole 231 may be defined in an extension portion 230 extending downward in one side of the first tray cover 221. A through-hole 404 may be defined in an extension portion 403 extending in one side of the second tray supporter 400.

The second ice maker 200 may further include a shaft 440 (or a rotation shaft) that simultaneously passes through the through-holes 231 and 404. A rotation arm 460 may be provided at each of both ends of the shaft 440. The shaft 440 may rotate by receiving rotational force from the driving portion 480. One end of the rotation arm 460 may be connected to one end of the elastic member 402, and thus, the rotation arm 460 may move to an initial position by restoring force when the elastic member 402 is tensioned.

The driving portion 480 may include a motor and a plurality of gears. A full ice detection lever 520 may be connected to the driving portion 480. The full ice detection lever 520 may also rotate by the rotational force provided by the driving portion 480.

The full ice detection lever 520 may have a 'C' shape as a whole. For example, the full ice detection lever 520 may include a first lever 521 and a pair of second levers 522 extending in a direction crossing the first lever 521 at both ends of the first lever 521. One of the pair of second levers 522 may be coupled to the driving portion 480, and the other may be coupled to the bracket 220. The full ice detection lever 520 may rotate to detect ice stored in the second ice bin 600.

The driving portion 480 may further include a cam that rotates by the rotational power of the motor. The second ice maker 200 may further include a sensor that senses the rotation of the cam. For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal. The controller to be described later may determine a position of the second tray 380 (or the second tray assembly) based on the type and pattern of the signal outputted from the sensor. That is, since the second tray 380 and the cam rotate by the motor, the position of the second tray 380 may be indirectly determined based on a detection signal of the magnet provided in the cam. For example, a water supply position, an ice-making position, and an ice-separation position, which will be described later, may be distinguished and determined based on the signals outputted from the sensor.

The second ice maker 200 may further include a second pusher 540. The second pusher 540 may be installed, for example, on the bracket 220. The second pusher 540 may include at least one pushing bar 544. For example, the second pusher 540 may include a pushing bar 544 provided with the same number as the number of ice-making cells 320*a*, but is not limited thereto.

The pushing bar 544 may push the ice disposed in the ice-making cell 320*a*. For example, the pushing bar 544 may pass through the second tray supporter 400 to contact the second tray 380 defining the ice-making cell 320*a* and then press the contacting second tray 380.

The second tray supporter 400 may be rotatably coupled to the first tray cover 221 with respect to the second tray supporter 400 and then be disposed to change in angle about the shaft 440.

In the present embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380. Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

The first tray 320 may be made of a metal material. In this case, since the coupling force or the attaching force between the first tray 320 and the ice is strong, the second ice maker 200 according to the present embodiment may include at least one of the ice separation heater (see reference numeral 290 in FIG. 23) and the first pusher 260. For another example, the first tray 320 may be made of a non-metallic material. When the first tray 320 is made of the non-metallic material, the second ice maker 200 may include only one of the ice separation heater 290 and the first pusher 260. Alternatively, the second ice maker 200 may not include the ice separation heater 290 and the first pusher 260.

Although not limited, the first tray 320 may be made of, for example, a silicon material. That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In the present embodiment, since the second tray 380 is pressed by the second pusher 540 to be deformed, the second tray 380 may have hardness less than that of the first tray 320 to facilitate the deformation of the second tray 380.

The second ice maker 200 may further include a temperature sensor 700. The temperature sensor 700 may sense a temperature of water or ice of the ice-making cell 320*a*.

The temperature sensor 700 may be disposed adjacent to the first tray 320 to sense the temperature of the first tray 320, thereby indirectly determining the water temperature or the ice temperature of the ice-making cell 320*a*. In the present embodiment, the water temperature or the ice temperature of the ice-making cell 320*a* may be referred to as an internal temperature of the ice-making cell 320*a*.

For example, the temperature sensor 700 may be installed in the bracket 220, and at least a portion of the temperature sensor 700 may be accommodated in the first tray 320.

Figure 9:
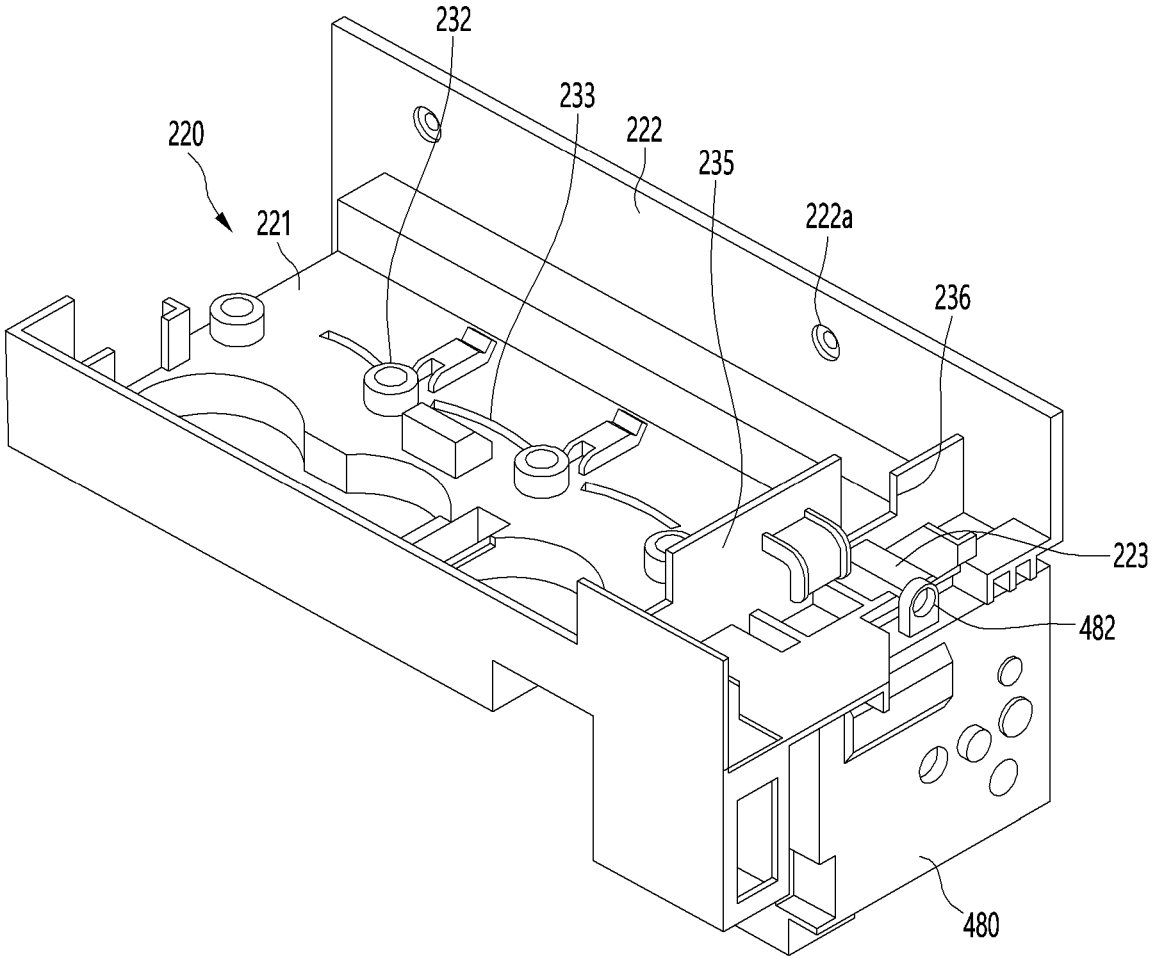
FIG. 9 is a bottom perspective view illustrating a state in which the driving portion is coupled to the bracket according to an embodiment of the present invention.

FIG. 9 is a bottom perspective view illustrating a state in which the driving portion is coupled to the bracket according to an embodiment of the present invention.

Referring to FIGS. 7 to 9, the bracket 220 may be fixed to the second ice-making chamber 114. The bracket 220 may include the first tray cover 221 as described above. The first tray 320 may be in contact with a bottom surface of the first tray cover 221 at a lower side of the first tray cover 221, and a portion of the first tray 320 may pass through the opening 221*a*.

The first tray cover 221 may include a heater case 280 extending downward around the opening 221*a*. The heater case 280 may include an accommodation groove 282 for accommodating the ice separation heater 290.

The ice separation heater 290 accommodated in the accommodation groove 282 may be installed to be in contact with the first tray 320 or may be disposed at a position spaced a predetermined distance from the first tray 320. In some cases, the ice separation heater 290 may supply heat to the first tray 320 in at least ice separation process, and the heat supplied to the first tray 320 may be transferred to the ice-making cell 320*a*.

The first tray cover 221 may include a pair of extension portions 230 extending downward. The shaft 440 may be coupled to the extension portions 230 by passing through through-holes 231 respectively formed in the pair of extension portions 230.

The first tray cover 221 may include a protrusion slot 233 to which a protrusion 327*c* protruding from the first tray 320 is coupled. The first tray 320 may be firmly fixed to the first tray cover 221 by the protrusion 327*c* and the protrusion slot 233.

The first tray cover 221 may further include a coupling boss 232 for coupling of the first tray supporter 300.

The bracket 220 may further include a bracket fixing wall 222 extending upward from a circumference of the first tray cover 221. A fixing hole 222*a* may be formed in the bracket fixing wall 222. A coupling member (not shown) may pass through the fixing hole 222*a* and be coupled to one side wall of the second ice-making chamber 114.

The bracket 220 may further include a barrier 235 extending upward from one side of the first tray cover 221. The barrier 235 may include a slot 236 for allowing cold air to flow toward the opening 221*a*.

The barrier 235 together with the bracket fixing wall 222 may allow the cold air flowing toward the opening 221*a* through the slot 236 to be stagnant around the opening 221*a*.

A first coupling protrusion 223 for coupling with the driving portion 480 may extend in a horizontal direction from the barrier 235. The driving portion 480 may include a second coupling protrusion 482 for coupling with the first coupling protrusion 223. The coupling member may couple the second coupling protrusion 482 to the first coupling protrusion 223.

The driving portion 480 may further include a coupling hook 481. The coupling hook 481 may be coupled to a hook hooking portion 235*a* of the bracket 220.

The bracket 220 may further include a pusher fixing wall 224 to which the second pusher 540 is fixed. For example, the pusher fixing wall 224 may be disposed right below the bracket fixing wall 222. The pusher fixing wall 224 may include an inclined wall 225 that is inclined in a direction away from the opening. The second pusher 540 may be installed on the inclined wall 225. A pusher installation portion 226 for installing the second pusher 540 may be provided on the inclined wall 225. A fixing extension portion 227 for fixing the pusher fixing wall 224 to the second ice-making chamber 114 may be provided on the inclined wall 225. A coupling hole 228 may be defined in the fixing extension portion 227.

The first tray cover 221 may further include a through-hole 229 through which the extension wall 301 of the first tray supporter 300 passes.

Figure 10:
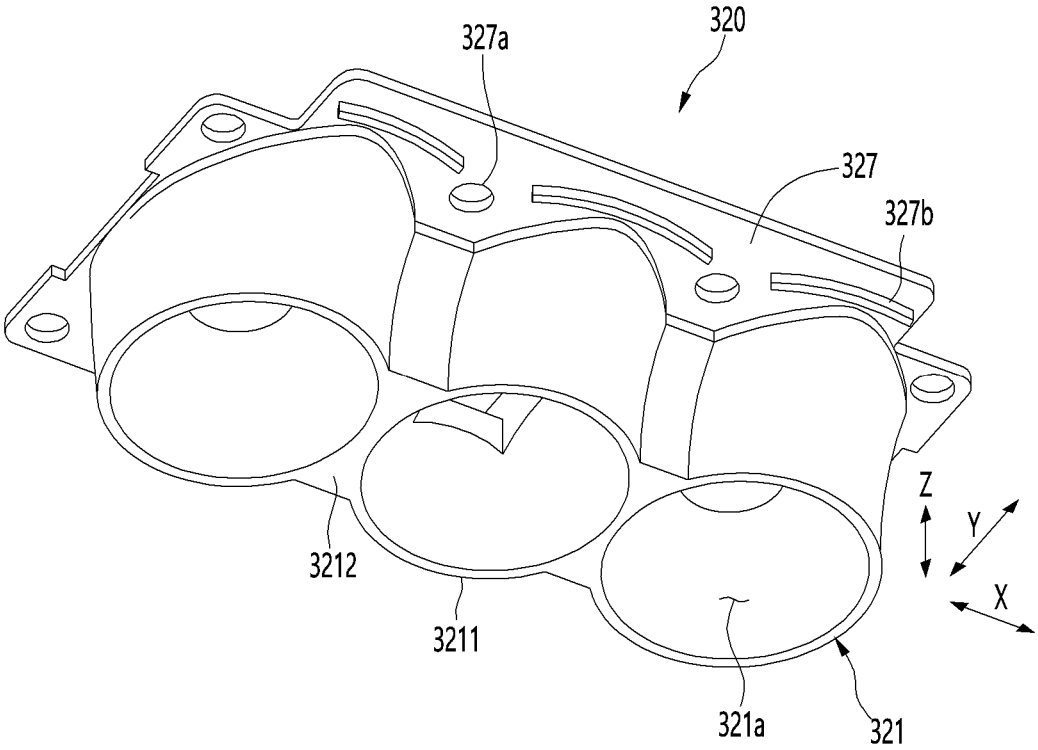
FIG. 10 is a perspective view of the first tray according to an embodiment of the present invention of the present invention.
Figure 11:
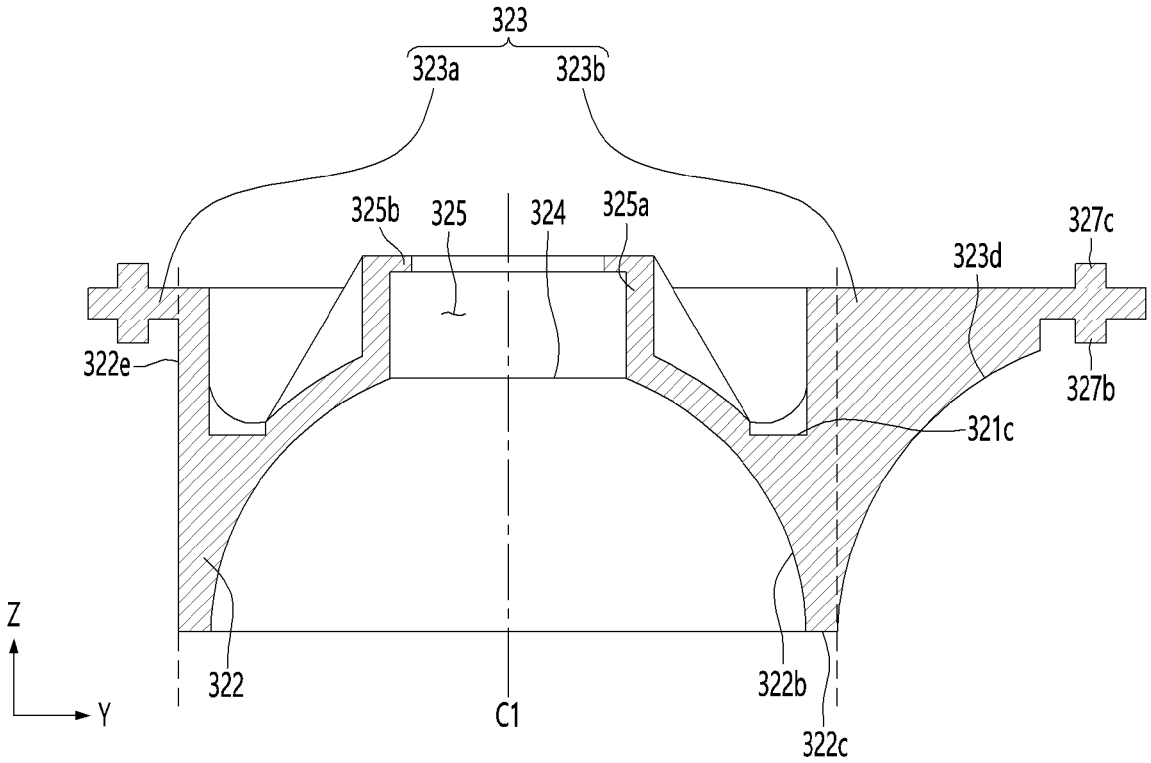
FIG. 11 is a cross-sectional view taken along Y-Z axis passing through a center of a first cell of the first tray of FIG. 10.
Figure 12:
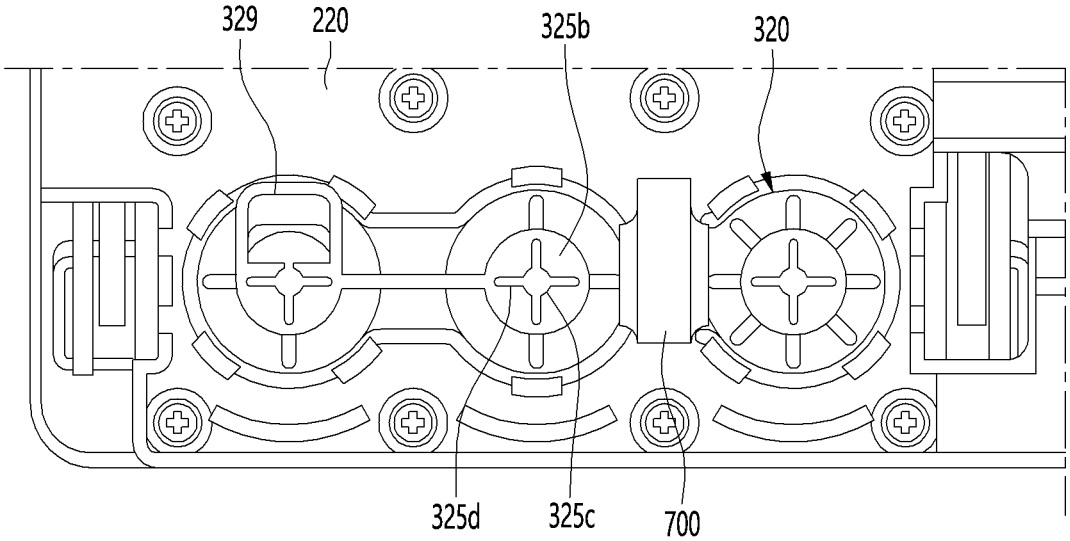
FIG. 12 is a partial plane view illustrating a state in which the first tray is installed on a bracket.

FIG. 10 is a perspective view of the first tray according to an embodiment of the present invention of the present invention, FIG. 11 is a cross-sectional view taken along Y-Z axis passing through a center of a first cell of the first tray of FIG. 10, and FIG. 12 is a partial plane view illustrating a state in which the first tray is installed on the bracket.

Referring to FIGS. 10 to 12, the first tray 320 may define a first cell 321*a* that is a portion of the ice-making cell 320*a*.

The first tray 320 may include a first tray wall 321 defining a portion of the ice-making cell 320*a*. For example, the first tray 320 may define a plurality of first cells 321*a*. For example, the plurality of first cells 321*a* may be arranged in line. Referring to FIG. 10, the plurality of first cells 321*a* may be arranged in an X-axis direction. For example, the first tray wall 321 may define the plurality of first cells 321*a*.

The first tray wall 321 may include a plurality of first cell walls 3211 that respectively define the plurality of first cells 321*a*, and a connection wall 3212 connecting the plurality of first cell walls 3211 to each other. The first tray wall 321 may be a wall extending in the vertical direction.

The first tray 320 may include an opening 324. The opening 324 may communicate with the first cell 321*a*. The opening 324 may allow the cold air to be supplied to the first cell 321*a*. The opening 324 may allow water for making ice to be supplied to the first cell 321*a*. The opening 234 may provide a passage through which a portion of the first pusher 260 passes. For example, in the ice separation process, a portion of the first pusher 260 may be inserted into the ice-making cell 320*a* through the opening 234.

The first tray 320 may include a plurality of openings 324 corresponding to the plurality of first cells 321*a*. One of the plurality of openings 324 may provide a passage of the cold air, a passage of the water, and a passage of the first pusher 260. In the ice-making process, air bubbles may escape through the opening 324 until ice is made at a side of the opening 324.

The first tray 320 may further include an auxiliary storage compartment 325 communicating with the ice-making cell 320*a*. For example, the auxiliary storage compartment 325 may store water overflowed from the ice-making cell 320*a*. The ice expanded in a phase-changing process of the supplied water may be disposed in the auxiliary storage compartment 325. That is, the expanded ice may pass through the opening 324 to be disposed in the auxiliary storage compartment 325. The auxiliary storage compartment 325 may be defined by a storage compartment wall 325*a*. The storage compartment wall 325*a* may extend upwardly around the opening 324. The storage compartment wall 325*a* may have a cylindrical shape or a polygonal shape.

Substantially, the first pusher 260 may pass through the opening 324 after passing through the storage compartment wall 325*a*. The storage compartment wall 325*a* may define the auxiliary storage compartment 325 and also reduce deformation of the periphery of the opening 324 when the first pusher 260 passes through the opening 324 during the ice separation process.

A blocking wall 325*b* may be provided on an upper end of the storage compartment wall 325*a* so that water of the ice-making cell 320*a* is prevented from overflowing to an outside of the storage compartment wall 325*a* through the opening 324 by the opening/closing of the refrigerating compartment door 10 or vibration of the refrigerator 1.

A through-hole 325*c* may be provided in a central portion of the blocking wall 325*b* so that the first pusher 260 passes through the blocking wall 325*b* while restricting the water overflow.

A diameter of the through-hole 325*c* may be less than a diameter of the pushing bar 264 of the first pusher 260. In order for the pushing bar 264 having a larger diameter than the through-hole 325*c* to pass through the through-hole 325*c* and be inserted into the ice-making cell 320*a*, the blocking wall 325*b* may be provided with a plurality of slits 325*d* extending in a radical direction of the through-hole 325*c*. The plurality of slits 325*d* may extend while being spaced apart from each other at a predetermined angle. FIG. 12 illustrates, for example, a structure in which four slits 325*d* are spaced apart from each other at an angle of 90 degrees to extend.

While the pushing bar 264 of the first pusher 260 moves downward, the pushing bar 264 may be in contact with the vicinity of the through-hole 325*c* in the blocking wall 325*b*, and thus, the blocking wall 325*b* may be deformed. Thus, the pushing bar 264 of the first pusher 260 may be inserted into the ice-making cell 320*a*. On the other hand, when the pushing bar 264 of the first pusher 260 moves upward, the pushing bar 264 may be drawn out of the storage compartment wall 325*a*, and the deformed blocking wall 325*b* may return to its original state.

At least one of the plurality of storage compartment walls 325*a* respectively corresponding to the plurality of first cells 321*a* may include a water supply wall 329 for providing a water passage. The water supply wall 329 may support the water supply portion 240.

The first tray 320 may include a first contact surface 322*c* contacting the second tray 380. The first tray 320 may further include a first extension wall 327 extending in the horizontal direction from the first tray wall 321. For example, the first extension wall 327 may extend in the horizontal direction around an upper end of the first extension wall 327. One or more first coupling holes 327*a* may be provided in the first extension wall 327. Although not limited, the plurality of first coupling holes 327*a* may be arranged in one or more axes of an X-axis and a Y-axis.

In this specification, the "central line" is a line passing through a volume center of the ice-making cell 320*a* or a center of gravity of water or ice in the ice-making cell 320*a* regardless of the axial direction.

Protrusions 327*b* and 327*c* may be disposed on the first extension wall 327 of the first tray 320. For example, one or more protrusions 327*c* may be disposed on a top surface of the first extension wall 327, and one or more protrusions 327*b* may be disposed on a bottom surface of the first extension wall 327.

Referring to FIG. 11, the first tray 320 may include a first portion 322 that defines a portion of the ice-making cell 320*a*. For example, the first portion 322 may be a portion of the first tray wall 321.

The first portion 322 may include a first cell surface 322*b* (or an outer circumferential surface) defining the first cell 321*a*. The first portion 322 may include the opening 324. Also, the first portion 322 may include a heater accommodation part 321*c*. The ice separation heater may be accommodated in the heater accommodation part 321*c*. The first portion 322 may be defined as an area between two dotted lines in FIG. 11.

The first portion 322 may be divided into a first region defined close to the transparent ice heater 430 and a second region defined far from the transparent ice heater 430 in the Z-axis direction. The first region may include the first contact surface 322*c*, and the second region may include the opening 324. The upper and lower portions of the first portion 322 may be divided based on an extension direction of a center line C1 (or a vertical center line) in the Z-axis direction in the ice-making cell 320*a*. The lowermost end of the first portion 322 is the first contact surface 322*c* contacting the second tray 380. The first tray 320 may further include a second portion 323 extending from a predetermined point of the first portion 322. The predetermined point of the first portion 322 may be one end of the first portion 322. Alternatively, the predetermined point of the first portion 322 may be one point of the first contact surface 322*c*.

A portion of the second portion 323 may be defined by the first tray wall 321, and the other portion of the second portion 323 may be defined by the first extension wall 327. At least a portion of the second portion 323 may extend in a direction away from the transparent ice heater 430. At least a portion of the second portion 323 may extend upward from the first contact surface 322*c*. At least a portion of the second portion 323 may extend in a direction away from the central line C1. For example, the second portion 323 may extend in both directions along the Y axis from the central line C1. The second portion 323 may be disposed at a position higher than or equal to the uppermost end of the ice-making cell 320*a*. The uppermost end of the ice-making cell 320*a* is a portion at which the opening 324 is defined. The second portion 323 may include a first extension portion 323*a* and a second extension portion 323*b*, which extend in different directions with respect to the central line C1.

The first tray wall 321 may include one portion of the second extension portion 323*b* of each of the first portion 322 and the second portion 323. The first extension wall 327 may include the other portion of each of the first extension portion 323*a* and the second extension portion 323*b*.

Referring to FIG. 11, the first extension portion 323*a* may be disposed at the left side with respect to the central line C1, and the second extension portion 323*b* may be disposed at the right side with respect to the central line C1. The first extension portion 323*a* and the second extension portion 323*b* may have different shapes based on the central line C1. The first extension portion 323*a* and the second extension portion 323*b* may be provided in an asymmetrical shape with respect to the central line C1. A length of the second extension portion 323*b* in the Y-axis direction may be greater than that of the first extension portion 323*a*. Therefore, while the ice is made and grown from the upper side in the ice making process, the deformation resistance degree of the second extension portion 323*b* may increase. The second extension portion 323*b* may be disposed closer to the shaft 440 that provides a center of rotation of the second tray assembly than to the first extension portion 323*a*.

In the present embodiment, since the length of the second extension portion 323*b* in the Y-axis direction is greater than that of the first extension portion 323*a*, the second tray assembly including the second tray 380 contacting the first tray 320 may increase in radius of rotation. When the rotation radius of the second tray assembly increases, centrifugal force of the second tray assembly may increase. Thus, in the ice separation process, separating force for separating the ice from the second tray assembly may increase to improve ice separation performance.

The temperature sensor 700 may be disposed between two adjacent first cells 321*a*. The temperature sensor 700 may be in contact with the first tray 320.

Figure 13:
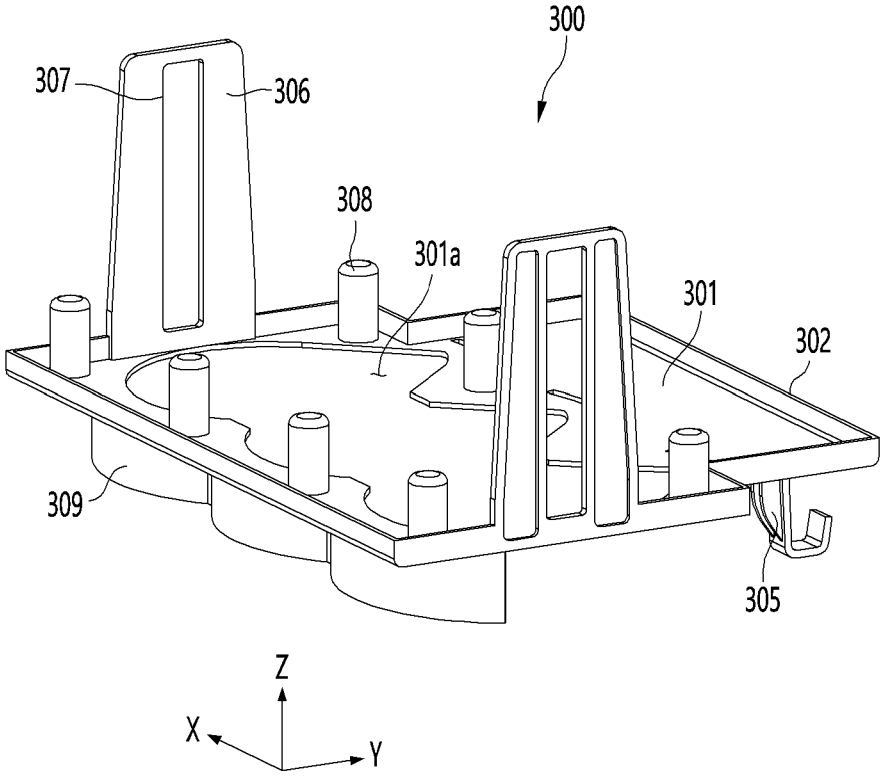
FIG. 13 is an upper perspective view of a first tray supporter according to an embodiment of the present invention.
Figure 14:
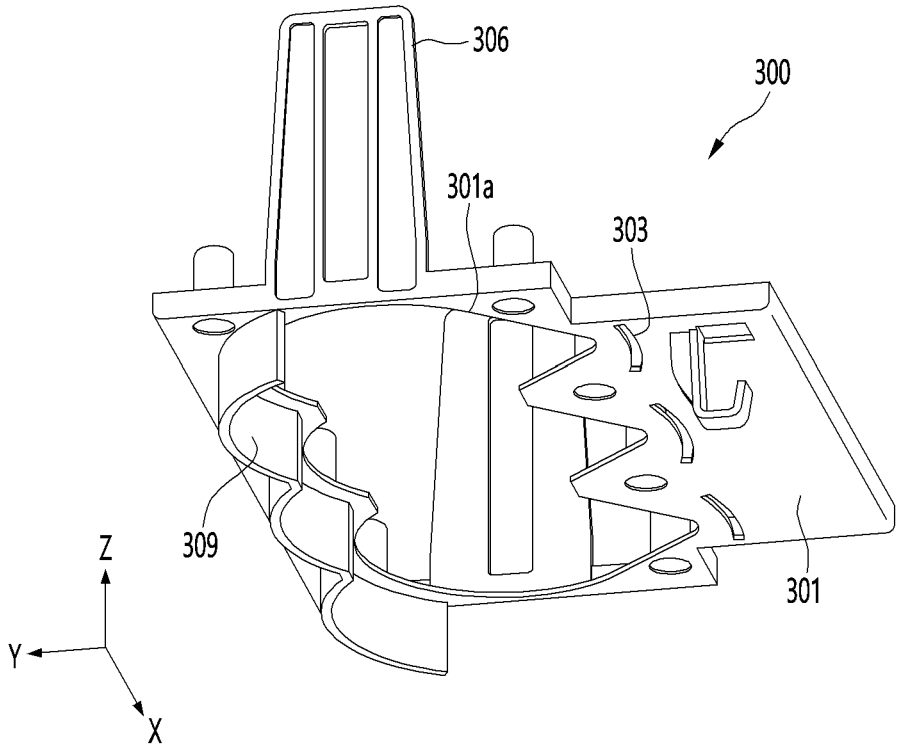
FIG. 14 is a bottom perspective view of the first tray supporter according to an embodiment of the present invention.
Figure 15:
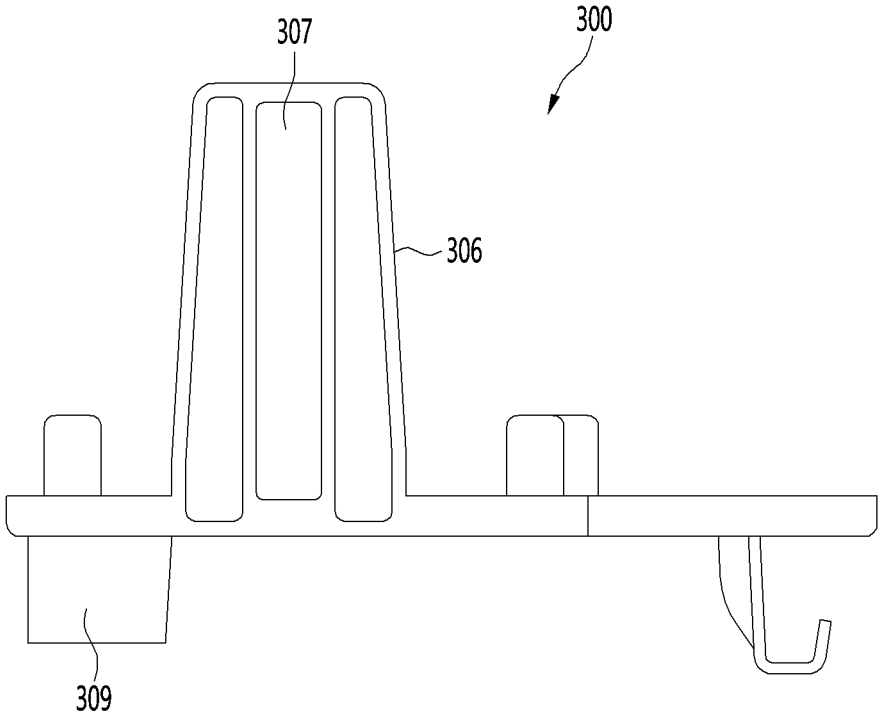
FIG. 15 is a side view of the first tray supporter according to an embodiment of the present invention.
Figure 16:
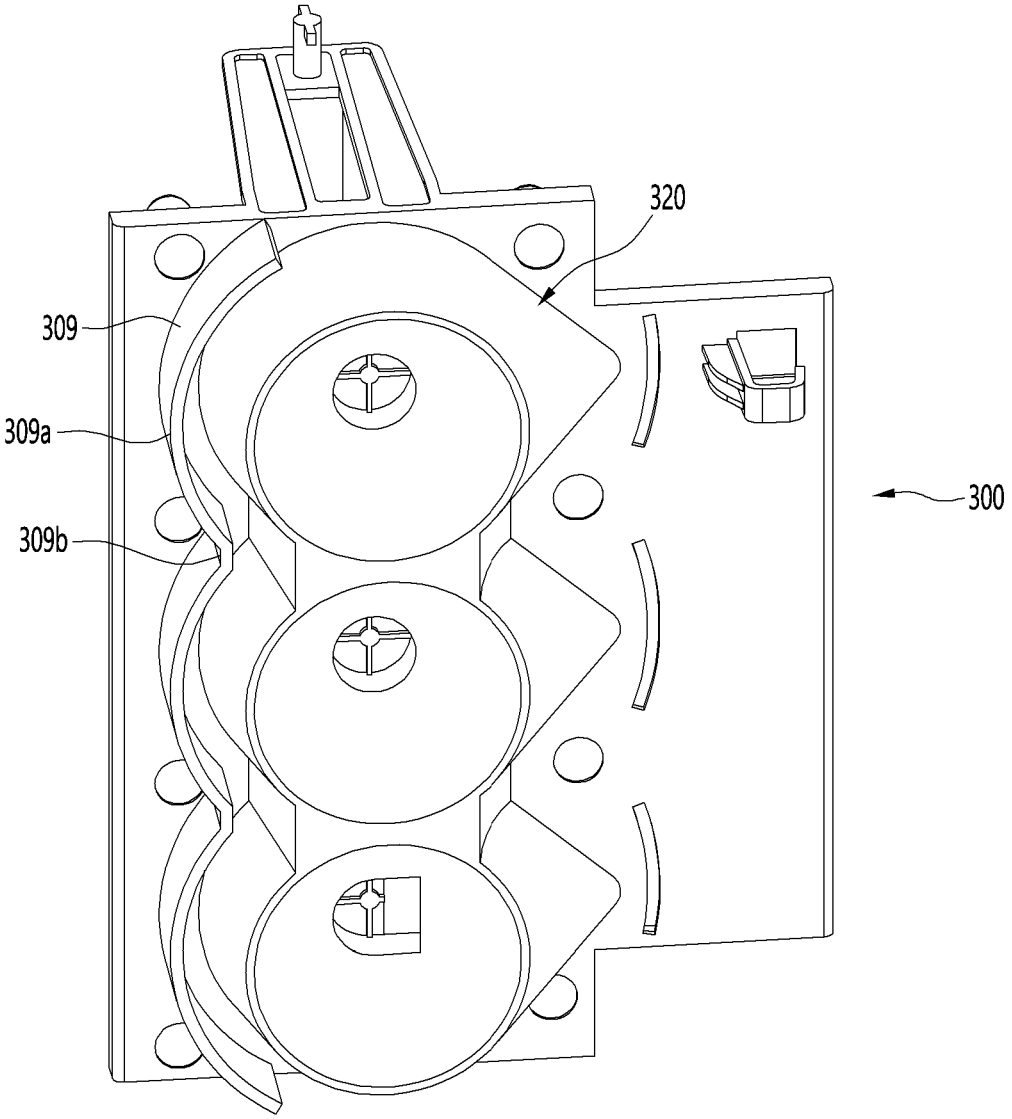
FIG. 16 is a view illustrating a state in which the first tray supporter and the first tray are coupled to each other.

FIG. 13 is an upper perspective view of the first tray supporter according to an embodiment of the present invention, FIG. 14 is a bottom perspective view of the first tray supporter according to an embodiment of the present invention, and FIG. 15 is a side view of the first tray supporter according to an embodiment of the present invention. FIG. 16 is a view illustrating a state in which the first tray supporter and the first tray are coupled to each other.

Referring to FIGS. 13 to 16, the first tray supporter 300 may include an upper plate 301 that is in contact with the first tray 320.

A bottom surface of the upper plate 301 may be coupled to contact an upper side of the first tray 320. For example, the upper plate 301 may be in contact with at least one of a top surface of the first portion 322 and a top surface of the second portion 323 of the first tray 320.

A plate opening 301*a* (or through-hole) may be defined in the upper plate 301. Water may be supplied from the water supply portion 240 to the first tray 320 through the plate opening 301*a*. In addition, the extension portion 264 of the first pusher 260 may pass through the plate opening 301*a* to separate ice from the first tray 320. In addition, cold air may pass through the plate opening 301*a* so as to be in contact with the first tray 320.

The barrier 302 extending upward may be disposed on an edge of the upper plate 301.

The first tray supporter 300 may include a plurality of extension walls 306 extending upward from the barrier 302. The plurality of extension walls 306 may be spaced apart from each other in the X-axis direction.

The first tray supporter 300 may be provided with a pair of guide slots 307 guiding movement of the first pusher 260. A portion of the guide slot 307 may be defined in the extension wall 306, and the other portion may be defined in the barrier 302 disposed below the extension wall 306. A lower portion of the guide slot 307 may be defined in the barrier 302. The guide slot 302 may extend in the Z-axis direction of FIG. 13. The first pusher 260 may be inserted into the guide slot 307. Also, the first pusher 260 may move up and down along the guide slot 307.

The first tray supporter 300 may include a plurality of coupling portions 308 to be coupled to the first tray case. The plurality of coupling portions 308 may be disposed on the upper plate 301.

The plurality of coupling portions 308 may be spaced apart from each other in the X-axis and/or Y-axis directions. The coupling portion 308 may protrude upward from the top surface of the upper plate 301. The coupling portion 308 may be aligned with the first coupling hole 327*a* of the first tray 320 and the coupling boss 322.

A coupling member may be coupled to the coupling portion 308. The coupling member coupled to the coupling portion 308 may be, for example, a bolt. The coupling member may be coupled to the coupling portion 308 through the first coupling hole 327*a* of the first tray 320 on a top surface of the coupling boss 322.

The first tray supporter 300 may include a guide rib 305 for guiding electric wires connected to the ice separation heater. The guide rib 305 may extend from a bottom surface of the upper plate 301.

The first tray supporter 300 may further include a protrusion slot 303 in which the protrusion 327*b* provided on the first tray 320 is accommodated. The protrusion slot 303 may be disposed in the upper plate 301.

The first tray supporter 300 may further include a water overflow prevention wall 309 (or barrier) for preventing water of the ice-making cell 320*a* from overflowing to the outside through a gap between the first tray 320 and the second tray 380 by opening and closing of the refrigerating compartment door 10 or vibration of the refrigerator 1 at the water supply position of the second tray 380.

For example, the water overflow prevention wall 309 may extend downward from the upper plate 301. The water overflow prevention wall 309 may be spaced apart from the plate opening 301*a* in a horizontal direction. For example, the water overflow prevention wall 309 may be spaced apart from the plate opening 301*a* in the Y-axis direction.

Thus, when the first tray 320 is coupled to the first tray supporter 300, the water overflow prevention wall 309 may be spaced apart from the first tray 320. A portion of the second tray 320 may be disposed in a spaced space between the water overflow prevention wall 309 and the first tray 320.

The water overflow prevention wall 309 may surround a portion of the first tray 320 while being spaced apart from the first tray 320 at the outside of the first tray 320. The water overflow prevention wall 309 may be provided in a shape corresponding to a circumference of a side surface of the first tray 320 so that an area surrounding the first tray 320 of the water overflow prevention wall 309 increases.

For example, the water overflow prevention wall 390 may include: a round portion 309*a* that is rounded in the horizontal direction; and a connection portion 309*b* that connects two adjacent round portions 309*a* to each other. For example, the round portion 309*a* may be provided in an arc shape using a center line of the ice-making cell 320*a* as a center. For example, the connection portion 309*b* may extend in a straight line.

The round portion 309*a* may be disposed to face the first cell wall 3211 of the first tray 320, and the connection part 390*b* may be disposed to face the connection wall 3212 of the first tray 320.

Figure 17:
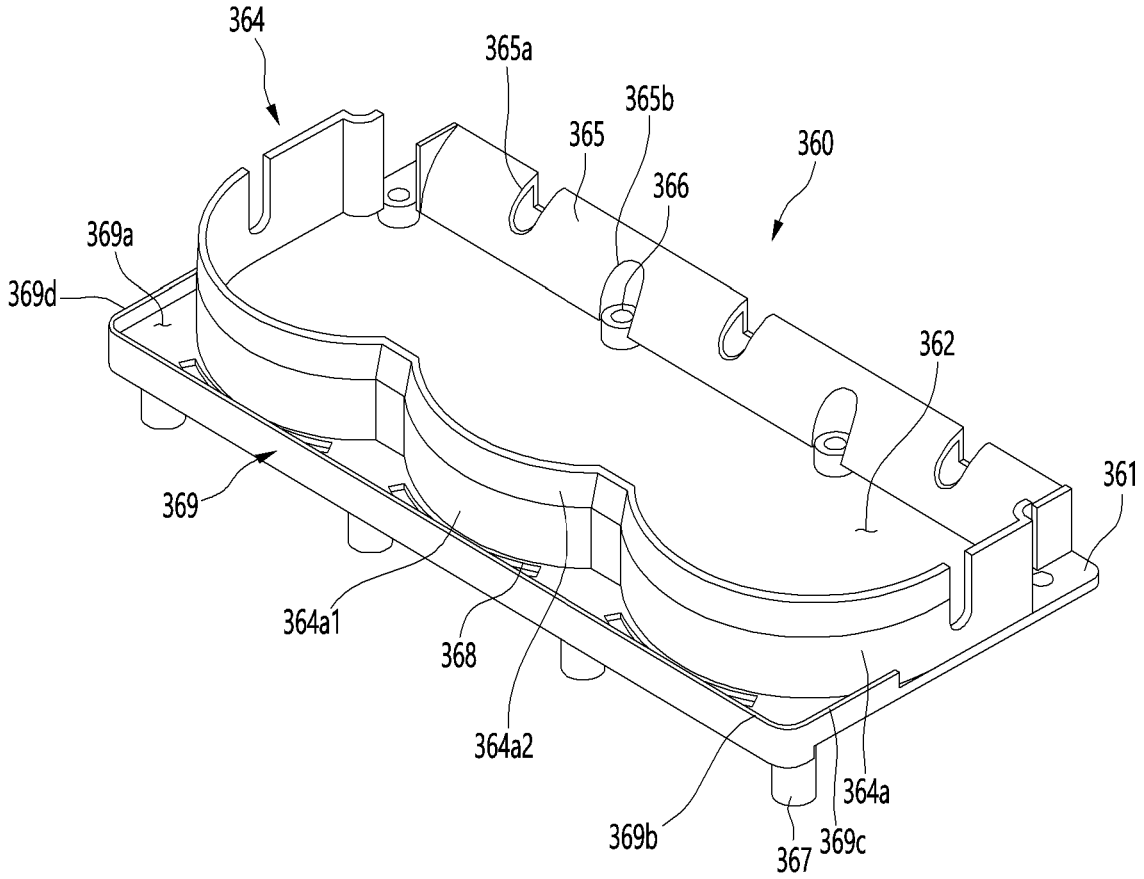
FIGS. 17 and 18 are perspective views of a second tray cover according to the present embodiment.
Figure 18:
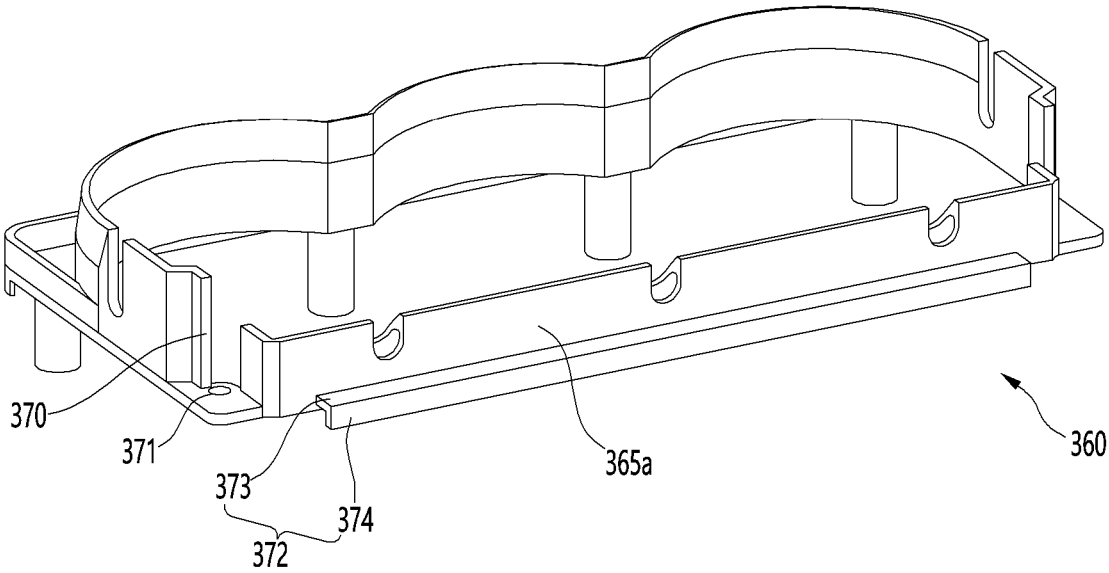
Figure 19:
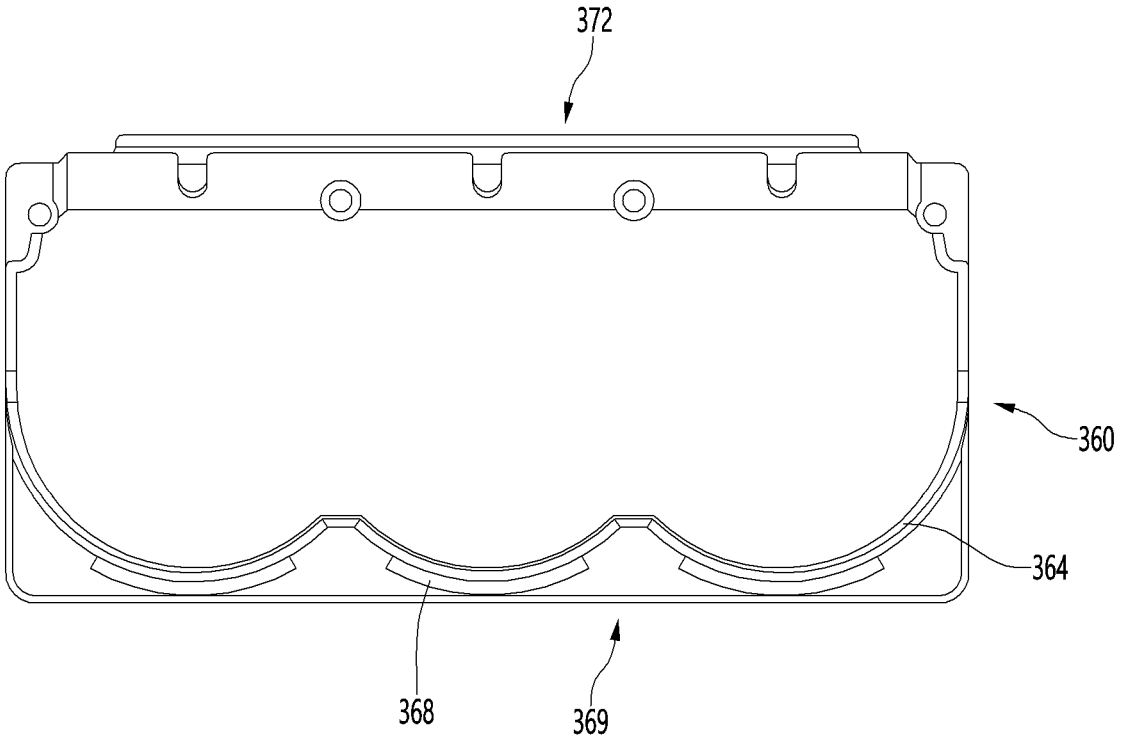
FIG. 19 is a plan view of the second tray cover according to the present embodiment.

FIGS. 17 and 18 are perspective views of the second tray cover according to the present embodiment, and FIG. 19 is a plan view of the second tray cover according to the present embodiment.

Referring to FIGS. 17 to 19, the second tray cover 360 according to the present embodiment may include a lower plate 361. A portion of the second tray 380 may be fixed to be in contact with a bottom surface of the lower plate 361.

An opening 362 through which a portion of the second tray 380 passes may be defined in the lower plate 361. For example, when the second tray 380 is fixed to the lower plate 361 in a state in which the second tray 380 is disposed below the lower plate 361, a portion of the second tray 380 may protrude upward from the lower plate 361 through the opening 362.

The lower case 360 may further include a circumferential wall 364 (or a cover wall) surrounding the second tray 380 passing through the lower plate 361. The circumferential wall 364 may include a first circumferential wall 364*a* and a second circumferential wall 365. The first circumferential wall 364*a* is disposed farther from a rotation center of the second tray 320 compared to the second circumferential wall 365.

The first circumferential wall 364*a* is a wall extending vertically upward from the lower plate 361. A portion of the first circumferential wall 364*a* may be rounded in the horizontal direction.

The second circumferential wall 365 is a wall that is rounded in a direction that is away from the opening 362 upward from the lower plate 361.

The second circumferential wall 365 may include a coupling slit 365*a* to be coupled to the second tray 380. The second coupling slit 365*a* may be defined in such a manner that an upper end of the second circumferential wall 365 is recessed downward. Of course, the coupling slit 365*a* may be omitted depending on the coupling structure.

Both ends of the first circumferential wall 364*a* may be spaced apart from both ends of the second circumferential wall 365. A slot 370 may be provided between an end of the first circumferential wall 364*a* and an end of the second circumferential wall 365. A coupling hole 371 may be defined at a position corresponding to the slot 370 in the lower plate 361. The slot 370 may provide a passage for a bolt coupled to the coupling hole.

The second tray cover 360 may further include a first coupling boss 366 and a second coupling boss 367. The first coupling boss 336 may protrude downward from the bottom surface of the lower plate 361. The second coupling boss 367 may protrude downward from the bottom surface of the lower plate 361. Of course, the first coupling boss 366 and the second coupling boss 367 may be omitted according to the coupling structure.

The first fastener may be coupled to the first coupling boss 366 at an upper portion of the first coupling boss 366. On the other hand, the second fastener may be coupled to the second coupling boss 367 at a lower portion of the second coupling boss 367.

A groove 365*b* for movement of the fastener may be defined in the second circumferential wall 365 to prevent the first fastener from interfering with the second circumferential wall 365 while the first fastener is coupled to the first coupling boss 366.

The second tray cover 360 may further include a slot 368 for coupling of the second tray 380. A portion of the second tray 380 may be inserted into the slot 368. The slot 368 may be disposed adjacent to the first circumferential wall 364*a*. Of course, the slot 368 may be omitted depending on the coupling structure.

The second tray case according to the present embodiment may further include a chamber wall 369. The chamber wall 369 may define a water accommodation chamber 369*a* for storing water overflowing from the ice-making cell 320*a*.

For example, the second tray cover 360 may include the chamber wall 369. The chamber wall 369 may extend upward from an edge of the lower plate 361.

The chamber wall 369 may be disposed adjacent to the first circumferential wall 364*a* of the lower plate 361. A height of the chamber wall 369 may be less than a height of the first circumferential wall 364*a*.

For example, the chamber wall 369 may include a first chamber wall 369*b* extending in the X-axis direction, and a second chamber wall 369*c* and a third chamber wall 369*d*, which extend in a direction crossing the first chamber wall 369*b* from both ends of the first chamber wall 369*b*.

The first chamber wall 369*b* may be spaced apart from the first circumferential wall 364*a*, and each of the second chamber wall 369*c* and the third chamber wall 369*d* may be connected to the first circumferential wall 364*a*.

The chamber wall 369, the first circumferential wall 364*a*, and the lower plate 361 may define a water accommodation chamber 369*a* in which water overflowing from the ice-making cell 320*a* is accommodated.

Since the first circumferential wall 364*a* is rounded in the horizontal direction, a distance between the first circumferential wall 364*a* and the first chamber wall 396*b* may be variable.

A height of the chamber wall 369 may be greater than a minimum distance between the first circumferential wall 364*a* and the first chamber wall 396*b* so that overflow of the water accommodation chamber 369*a* is minimized.

Since a portion of the lower plate 361 defines a bottom surface of the water accommodation chamber 369*a*, a portion of the lower plate 361 may be referred to as a bottom wall.

The slot 368 may be define in a portion of the lower plate 361 defining the water accommodation chamber 369*a*. The slot 368 may be disposed between the first chamber wall 369*b* and the first circumferential wall 364*a*.

The first circumferential wall 364*a* may include a vertical surface 364*a*1 and an inclined surface 364*a*2. The vertical surface 364*a*1 is a surface extending upward from the lower plate 361, and the inclined surface 364*a*2 is a surface extending from an upper end of the vertical surface 364*a*1. The inclined surface 364*a*2 may extend in a direction away from the first chamber wall 369*b* as it goes upward from the vertical surface 364*a*1.

A portion of the inclined surface 364*a*2 adjacent to the second chamber wall 369*c* may extend in a direction away from the second chamber wall 369*c* as it goes upward from the vertical surface 364*a*1.

A portion of the inclined surface 364*a*2 adjacent to the third chamber wall 369*d* may extend in a direction away from the third chamber wall 369*d* as it goes upward from the vertical surface 364*a*1.

The second tray cover 360 may further include a seating portion 372. The seating portion 372 may be seated on a lower plate 401 of the second tray supporter 400 to be described later. A support wall 365*a* may extend downward from an upper end of the second circumferential wall 365. The support wall 365*a* may prevent the second circumferential wall 365 from being deformed.

The seating portion 372 may extend from the support wall 365*a*. The seating portion 372 may include a first extension portion 373 extending backward from the support wall 365*a* and a second extension portion 374 extending downward from the first extension portion 373. A bottom surface of the second extension portion 374 may be seated on a lower plate 401 to be described later.

Figure 20:
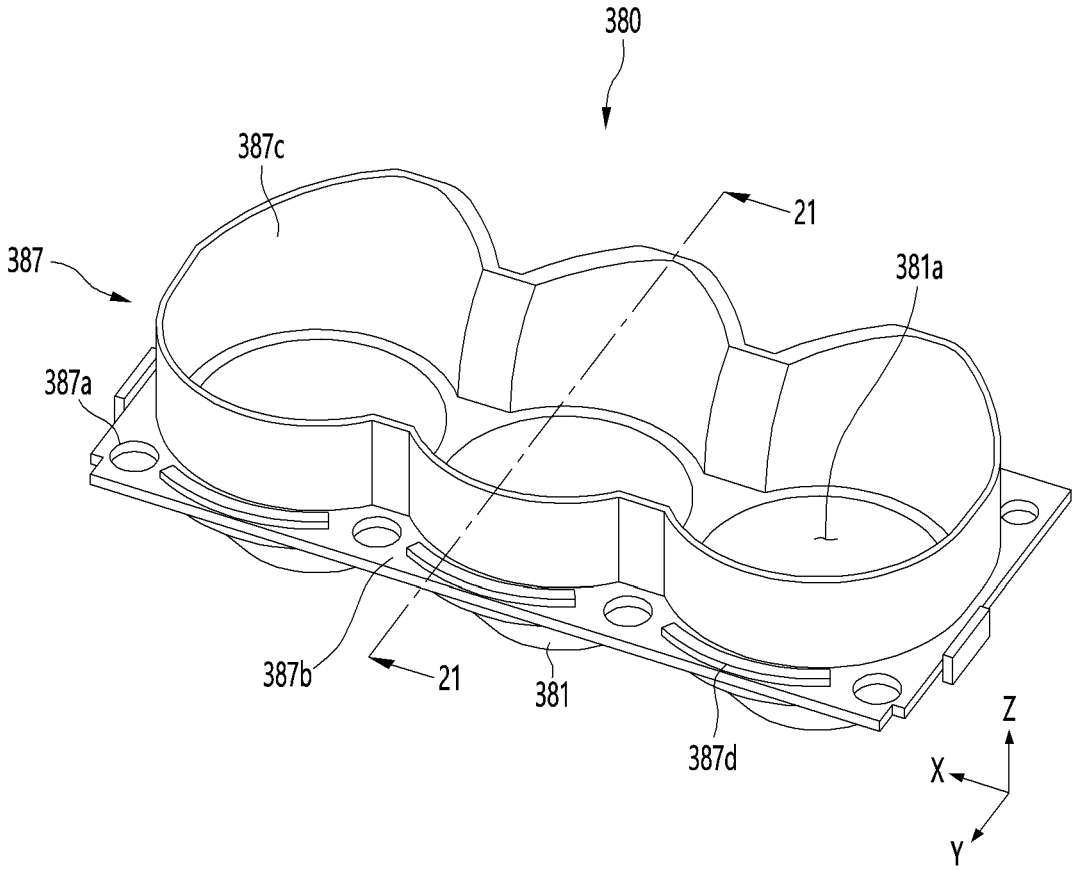
FIG. 20 is a perspective view of a second tray when viewed from an upper side according to an embodiment of the present invention.
Figure 21:
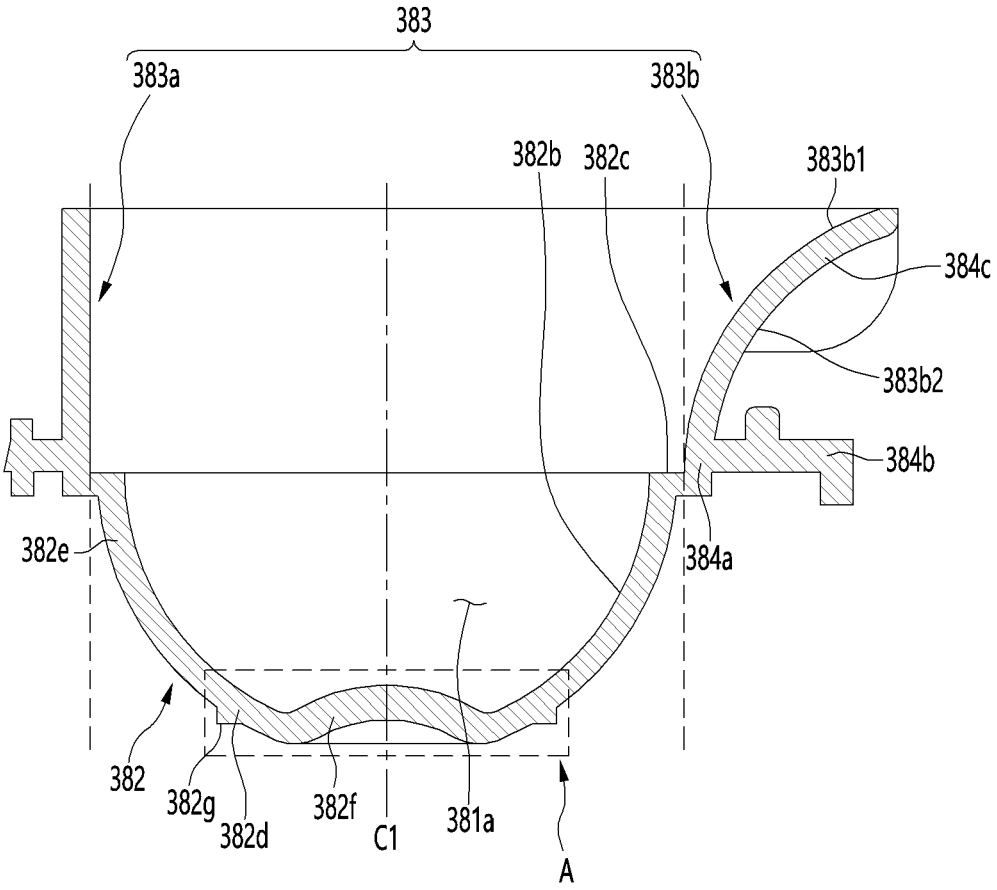
FIG. 21 is a cross-sectional view taken along line 21-21 of FIG. 20.

FIG. 20 is a perspective view of the second tray when viewed from an upper side according to an embodiment of the present invention, and FIG. 21 is a cross-sectional view taken along line 21-21 of FIG. 20.

Referring to FIGS. 20 and 21, the second tray 380 may define a second cell 381*a* which is another portion of the ice-making cell 320*a*. The second tray 380 may include a second tray wall 381 defining a portion of the ice-making cell 320*a*. For example, the second tray 380 may define a plurality of second cells 381*a*. For example, the plurality of second cells 381*a* may be arranged in a line. Referring to FIG. 20, the plurality of second cells 381*a* may be arranged in the X-axis direction. For example, the second tray wall 381 may define the plurality of second cells 381*a*.

The second tray 380 may include a barrier 387 extending along a circumference of an upper end of the second tray wall 381. The barrier 387 may be formed integrally with the second tray wall 381 and may extend from an upper end of the second tray wall 381.

For another example, the barrier 387 may be provided separately from the second tray wall 381 and disposed around the upper end of the second tray wall 381. In this case, the barrier 387 may be in contact with the second tray wall 381 or be spaced apart from the second tray wall 381. In any case, the barrier 387 may surround at least a portion of the first tray 320.

If the second tray 380 includes the barrier 387, the second tray 380 may surround the first tray 320. When the second tray 380 and the barrier 387 are provided separately from each other, the barrier 387 may be integrally formed with the second tray case or may be coupled to the second tray case. For example, one second tray wall may define a plurality of second cells 381*a*, and one continuous barrier 387 may surround the first tray 250.

The barrier 387 may include a first extension wall 387*b* extending in the horizontal direction and a second extension wall 387*c* extending in the vertical direction. The first extension wall 387*b* may be provided with one or more second coupling holes 387*a* to be coupled to the second tray case. The plurality of second coupling holes 387*a* may be arranged in at least one axis of the X axis or the Y axis. One or more protrusions 387*d* to be coupled to the second tray case may be provided on the first extension wall 387*b*.

The second tray 380 may include a second contact surface 382*c* contacting the first contact surface 322*c* of the first tray 320. The first contact surface 322*c* and the second contact surface 382*c* may be horizontal planes. Each of the first contact surface 322*c* and the second contact surface 382*c* may be provided in a ring shape. When the ice-making cell 320*a* has a spherical shape, each of the first contact surface 322*c* and the second contact surface 382*c* may have a circular ring shape.

The second tray 380 may include a first portion 382 that defines at least a portion of the ice-making cell 320*a*. For example, the first portion 382 may be a portion or the whole of the second tray wall 381.

In this specification, the first portion 322 of the first tray 320 may be referred to as a third portion so as to be distinguished from the first portion 382 of the second tray 380. Also, the second portion 323 of the first tray 320 may be referred to as a fourth portion so as to be distinguished from the second portion 383 of the second tray 380.

The first portion 382 may include a second cell surface 382*b* (or an outer circumferential surface) defining the second cell 381*a* of the ice ice-making cell 320*a*. The first portion 382 may be defined as an area between two dotted lines in FIG. 19. The uppermost end of the first portion 382 is the second contact surface 382*c* contacting the first tray 320.

The second tray 380 may further include a second portion 383. The second portion 383 may reduce transfer of heat, which is transferred from the transparent ice heater 430 to the second tray 380, to the ice-making cell 320*a* defined by the first tray 320. That is, the second portion 383 serves to allow the heat conduction path to move in a direction away from the first cell 321*a*. The second portion 383 may be a portion or the whole of the barrier 387. The second portion 383 may extend from a predetermined point of the first portion 382. In the following description, for example, the second portion 383 is connected to the first portion 382.

The predetermined point of the first portion 382 may be one end of the first portion 382. Alternatively, the predetermined point of the first portion 382 may be one point of the second contact surface 382*c*. The second portion 383 may include the other end that does not contact one end contacting the predetermined point of the first portion 382. The other end of the second portion 383 may be disposed farther from the first cell 321*a* than one end of the second portion 383.

At least a portion of the second portion 383 may extend in a direction away from the first cell 321*a*. At least a portion of the second portion 383 may extend in a direction away from the second cell 381*a*. At least a portion of the second portion 383 may extend upward from the second contact surface 382*c*. At least a portion of the second portion 383 may extend horizontally in a direction away from the central line C1. A center of curvature of at least a portion of the second portion 383 may coincide with a center of rotation of the shaft 440 which is connected to the driving portion 480 to rotate.

The second part 383 may include a first part 384*a* extending from one point of the first portion 382. The second portion 383 may further include a second part 384*b* extending in the same direction as the extending direction with the first part 384*a*. Alternatively, the second portion 383 may further include a third part 384*c* extending in a direction different from the extending direction of the first part 384*a*.

Alternatively, the second portion 383 may further include a second part 384*b* and a third part 384*c* branched from the first part 384*a*.

For example, the first part 384*a* may extend in the horizontal direction from the first part 382. A portion of the first part 384*a* may be disposed at a position higher than that of the second contact surface 382*c*. That is, the first part 384*a* may include a horizontally extension portion and a vertically extension portion. The first part 384*a* may further include a portion extending from the predetermined point in a vertical direction. A length of the second extension portion 323*b* in the Y-axis direction may be greater than that of the first extension portion 323*a*.

The extension direction of at least a portion of the first part 384*a* may be the same as that of the second part 384*b*. The extension directions of the second part 384*b* and the third part 384*c* may be different from each other. The extension direction of the third part 384*c* may be different from that of the first part 384*a*. The third part 384*c* may have a constant curvature based on the Y-Z cutting surface. That is, the same curvature radius of the third part 384*c* may be constant in the longitudinal direction. The curvature of the second part 384*b* may be zero. When the second part 384*b* is not a straight line, the curvature of the second part 384*b* may be less than that of the third part 384*c*. The curvature radius of the second part 384*b* may be greater than that of the third part 384*c*.

At least a portion of the second portion 383 may be disposed at a position higher than or equal to that of the uppermost end of the ice-making cell 320*a*. In this case, since the heat conduction path defined by the second portion 383 is long, the heat transfer to the ice-making cell 320*a* may be reduced. A length of the second portion 383 may be greater than the radius of the ice-making cell 320*a*. The second portion 383 may extend up to a point higher than the center of rotation of the shaft 440. For example, the second portion 383 may extend up to a point higher than the uppermost end of the shaft 440. The second portion 383 may include a first extension portion 383*a* extending from a first point of the first portion 382 and a second extension portion 383*b* extending from a second point of the first portion 382 so that transfer of the heat of the transparent ice heater 430 to the ice-making cell 320*a* defined by the first tray 320 is reduced. For example, the first extension portion 383*a* and the second extension portion 383*b* may extend in different directions with respect to the central line C1.

Referring to FIG. 21, the first extension portion 383*a* may be disposed at the left side with respect to the central line C1, and the second extension portion 383*b* may be disposed at the right side with respect to the central line C1. The first extension portion 383*a* and the second extension portion 383*b* may have different shapes based on the central line C1. The first extension portion 383*a* and the second extension portion 383*b* may be provided in an asymmetrical shape with respect to the central line C1. A length (horizontal length) of the second extension portion 383*b* in the Y-axis direction may be longer than the length (horizontal length) of the first extension portion 383*a*. The second extension portion 383*b* may be disposed closer to the shaft 440 that provides a center of rotation of the second tray assembly than the first extension portion 383*a*.

In the present embodiment, a length of the second extension portion 383*b* in the Y-axis direction may be greater than that of the first extension portion 383*a*. In this case, the heat conduction path may increase while reducing the width of the bracket 220 relative to the space in which the second ice maker 200 is installed. Since the length of the second extension portion 383*b* in the Y-axis direction is greater than that of the first extension portion 383*a*, the second tray assembly including the second tray 380 contacting the first tray 320 may increase in radius of rotation. When the rotation radius of the second tray assembly increases centrifugal force of the second tray assembly may increase. Thus, in the ice separation process, separating force for separating the ice from the second tray assembly may increase to improve ice separation performance.

The center of curvature of at least a portion of the second extension portion 383*b* may be a center of curvature of the shaft 440 which is connected to the driving portion 480 to rotate.

A distance between an upper portion of the first extension portion 383*a* and an upper portion of the second extension portion 383*b* may be greater than that between a lower portion of the first extension portion 383*a* and a lower portion of the second extension portion 383*b* with respect to the Y-Z cutting surface passing through the central line C1. For example, a distance between the first extension portion 383*a* and the second extension portion 383*b* may increase upward.

Each of the first extension portion 383*a* and the third extension portion 383*b* may include first to third parts 384*a*, 384*b*, and 384*c*. In another aspect, the third part 384*c* may also be described as including the first extension portion 383*a* and the second extension portion 383*b* extending in different directions with respect to the central line C1.

The first portion 382 may include a first region 382*d* (see region A in FIG. 21) and a second region 382*e* (a region except for the region A). The curvature of at least a portion of the first region 382*d* may be different from that of at least a portion of the second region 382*e*. The first region 382*d* may include the lowermost end of the ice-making cell 320*a*. The second region 382*e* may have a diameter greater than that of the first region 382*d*. The first region 382*d* and the second region 382*e* may be divided vertically.

The transparent ice heater 430 may be in contact with the first region 382*d*. The first region 382*d* may include a heater contact surface 382*g* contacting the transparent ice heater 430. The heater contact surface 382*g* may be, for example, a horizontal plane. The heater contact surface 382*g* may be disposed at a position higher than that of the lowermost end of the first portion 382. The second region 382*e* may include the second contact surface 382*c*. The first region 382*d* may have a shape recessed in a direction opposite to a direction in which ice is expanded in the ice-making cell 320*a*.

A distance from the center of the ice-making cell 320*a* to the second region 382*e* may be less than that from the center of the ice-making cell 320*a* to the portion at which the shape recessed in the first area 382*d* is disposed. For example, the first region 382*d* may include a pressing part 382*f* that is pressed by the second pusher 540 during the ice separation process. When pressing force of the second pusher 540 is applied to the pressing part 382*f*, the pressing part 382*f* is deformed, and thus, ice is separated from the first portion 382. When the pressing force applied to the pressing part 382*f* is removed, the pressing part 382*f* may return to its original shape. The central line C1 may pass through the first region 382*d*. For example, the central line C1 may pass through the pressing part 382*f*.

The heater contact surface 382*g* may be disposed to surround the pressing part 382*f*. The heater contact surface 382*g* may be disposed at a position higher than that of the lowermost end of the pressing part 382*f*. At least a portion of the heater contact surface 382*g* may be disposed to surround the central line C1. Accordingly, at least a portion of the transparent ice heater 430 contacting the heater contact surface 382*g* may be disposed to surround the central line C1. Therefore, the transparent ice heater 430 may be prevented from interfering with the second pusher 540 while the second pusher 540 presses the pressing part 382*f*. A distance from the center of the ice-making cell 320*a* to the pressing part 382*f* may be different from that from the center of the ice-making cell 320*a* to the second region 382*e*.

Figure 22:
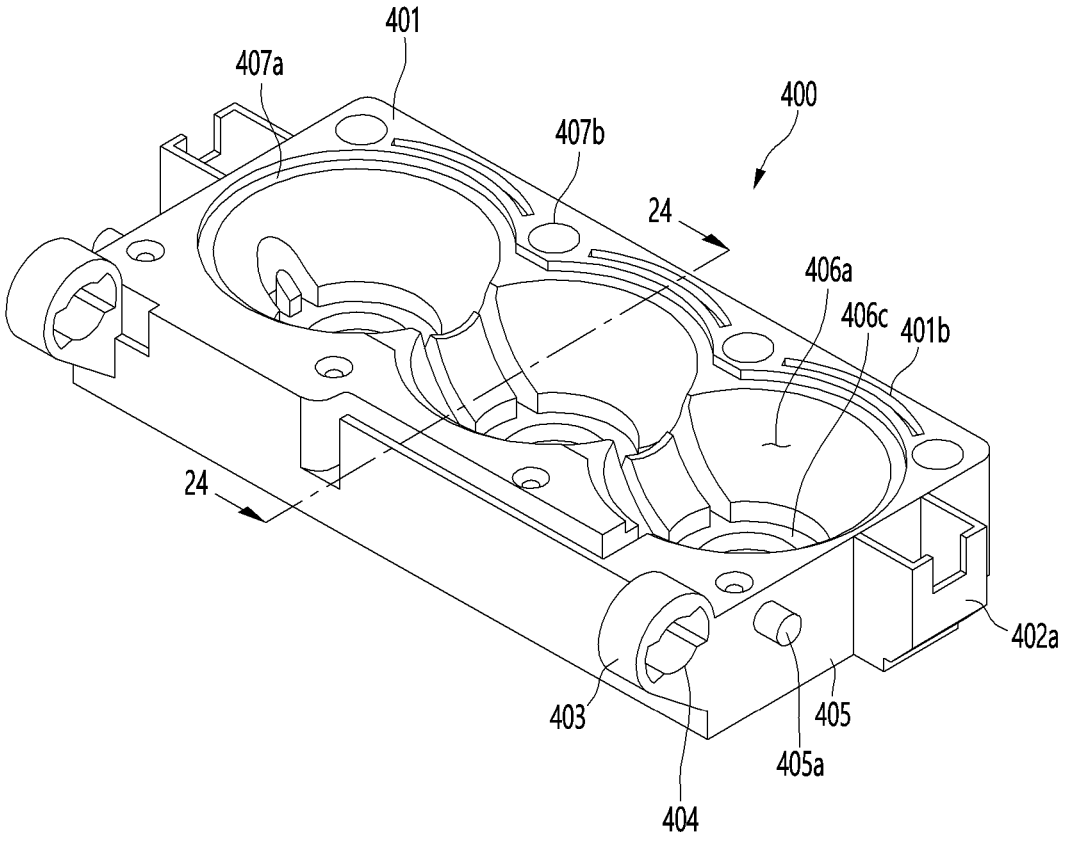
FIG. 22 is a perspective view illustrating an upper portion of a second tray supporter.
Figure 23:
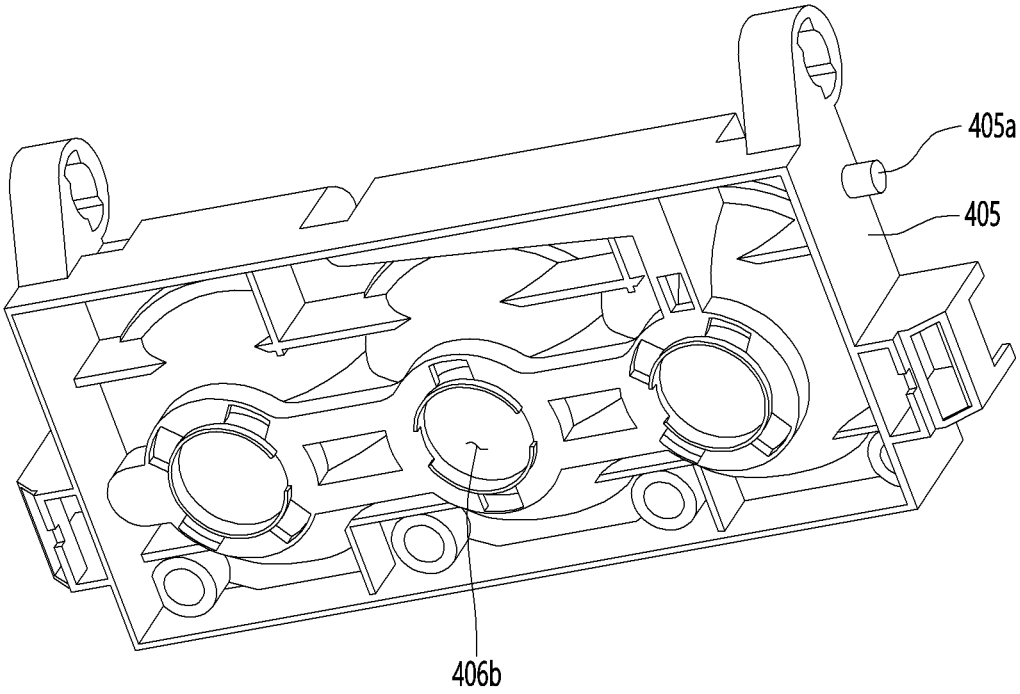
FIG. 23 is a bottom perspective view of the second tray supporter.
Figure 24:
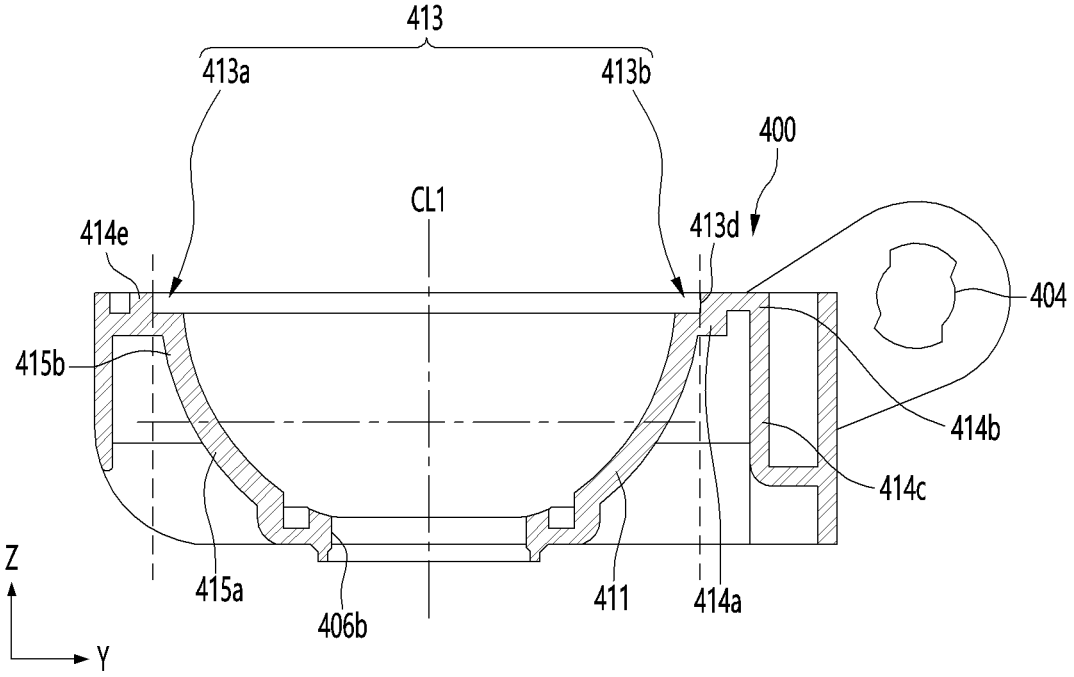
FIG. 24 is a cross-sectional view taken along line 24-24 of FIG. 22.

FIG. 22 is a perspective view illustrating an upper portion of the second tray supporter, FIG. 23 is a bottom perspective view of the second tray supporter, and FIG. 24 is a cross-sectional view taken along line 24-24 of FIG. 22.

Referring to FIGS. 22 to 24, the second tray supporter 400 may include a support body 407 on which a lower portion of the second tray 380 is seated.

The support body 407 may include an accommodation space 406*a* in which a portion of the second tray 380 is accommodated. The accommodation space 406*a* may be defined corresponding to the first portion 382 of the second tray 380, and a plurality of accommodation spaces 406*a* may be provided.

The support body 407 may include a lower opening 406*b* (or a through-hole) through which a portion of the second pusher 540 passes. For example, three lower openings 406*b* may be provided in the support body 407 to correspond to the three accommodation spaces 406*a*.

Also, a portion of the lower portion of the second tray 380 may be exposed by the lower opening 406*b*. At least a portion of the second tray 380 may be disposed in the lower opening 406*b*. A top surface 407*a* of the support body 407 may extend in the horizontal direction.

The second tray supporter 400 may further include a heater coupling portion 406*c*. The heater coupling portion 406*c* may be recessed downward from a surface of the supporter body 407, which is in contact with the second tray 380. A portion of the heater coupling portion 406*c* may be disposed to surround the lower opening 406*b*. The transparent ice heater 430 may be coupled to the heater coupling portion 406*c*.

The second tray supporter 400 may include a top surface 407*a* of the support body 407 and a stepped lower plate 401.

The second tray 380 may be inserted and coupled between the second tray cover 360 and the second tray supporter 400. For example, the second tray 380 may be disposed below the second tray cover 360, and the second tray 380 may be accommodated above the second tray supporter 400.

One or more coupling holes 407*b* may be defined in the supporter body 407. The coupling hole 407*b* may be aligned with the second coupling hole 387*a* of the second tray 380.

The second tray supporter 400 may further include a vertical extension wall 405 extending vertically downward from an edge of the lower plate 401.

One surface of the vertical extension wall 405 may be provided with a pair of extension portions 403 coupled to the shaft 440 to allow the second tray 380 to rotate. The pair of extension portions 403 may be spaced apart from each other in the X-axis direction. Also, each of the extension portions 403 may further include a through-hole 404. The shaft 440 may pass through the through-hole 404, and the extension portion 230 of the first tray cover 221 may be disposed inside the pair of extension portions 403.

The second tray supporter 400 may further include an elastic member coupling portion 402*a* to which the elastic member 402 is coupled. The elastic member coupling portion 402*a* may provide a ring to be hooked with a lower end of the elastic member 402.

The second tray supporter 400 may further include a link connection part 405*a* to which the pusher link 500 is coupled. For example, the link connection part 405*a* may protrude from the vertical extension wall 405.

Referring to FIG. 24, the second tray supporter 400 may include a first portion 411 supporting the second tray 380 defining at least a portion of the ice-making cell 320*a*. In FIG. 22, the first portion 411 may be an area between two dotted lines. For example, the support body 407 may define the first portion 411. The second tray supporter 400 may further include a second portion 413 extending from a predetermined point of the first portion 411.

The second portion 413 may reduce transfer of heat, which is transfer from the transparent ice heater 430 to the second tray supporter 400, to the ice-making cell 320*a* defined by the first tray 320. At least a portion of the second portion 413 may extend in a direction away from the first cell 321*a* defined by the first tray 320. In the second portion 413, the direction away from the first cell 321 may be a horizontal direction passing through the center of the ice-making cell 320*a*. In the second portion 413, the direction away from the first cell 321 may be a downward direction with respect to a horizontal line passing through the center of the ice-making cell 320*a*.

The second part 413 may include a first part 414*a* extending in the horizontal direction from the predetermined point and a second part 414*b* extending in the same direction as the first part 414*a*. The second part 413 may include a first part 414*a* extending in the horizontal direction from the predetermined point, and a third part 414*c* extending in a direction different from that of the first part 414*a*. The second part 413 may include a first part 414*a* extending in the horizontal direction from the predetermined point, and a second part 414*b* and a third part 414*c*, which are branched from the first part 414*a*. A top surface 407*a* of the support body 407 may provide, for example, the first part 414*a*.

The first part 414*a* may further include a fourth part 413*d* extending in the vertical line direction. The lower plate 401 may provide, for example, the fourth part 413*d*. The vertical extension wall 405 may provide, for example, the third part 414*c*. A length of the third part 414*c* may be greater than that of the second part 414*b*. The second part 414*b* may extend in the same direction as the first part 414*a*. The third part 414*c* may extend in a direction different from that of the first part 414*a*.

The second portion 413 may be disposed at the same height as the lowermost end of the first cell 321*a* or extend up to a lower point. The second portion 413 may include a first extension portion 413*a* and a second extension portion 413*b* which are disposed opposite to each other with respect to the center line CL1 corresponding to the center line C1 of the ice-making cell 320*a*.

Referring to FIG. 24, the first extension portion 413*a* may be disposed at a left side with respect to the center line CL1, and the second extension portion 413*b* may be disposed at a right side with respect to the center line CL1. The first extension portion 413*a* and the second extension portion 413*b* may have different shapes with respect to the center line CL1. The first extension portion 413*a* and the second extension portion 413*b* may have shapes that are asymmetrical to each other with respect to the center line CL1. A length of the second extension portion 413*b* may be greater than that of the first extension portion 413*a* in the horizontal direction. That is, a length of the thermal conductivity of the second extension portion 413*b* is greater than that of the first extension portion 413*a*. The second extension portion 413*b* may be disposed closer to the shaft 440 that provides a center of rotation of the second tray assembly than the first extension portion 413*a*. In the present embodiment, since the length of the second extension portion 413*b* in the Y-axis direction is greater than that of the first extension portion 413*a*, the second tray assembly including the second tray 380 contacting the first tray 320 may increase in radius of rotation.

A center of curvature of at least a portion of the second extension portion 413*a* may coincide with a center of rotation of the shaft 440 which is connected to the driving portion 480 to rotate. The first extension portion 413*a* may include a portion 414*e* extending upwardly with respect to the horizontal line. The portion 414*e* may surround, for example, a portion of the second tray 380.

In another aspect, the second tray supporter 400 may include a first region 415*a* including the lower opening 406*b* and a second region 415*b* having a shape corresponding to the ice-making cell 320*a* to support the second tray 380.

For example, the first region 415*a* and the second region 415*b* may be divided vertically. In FIG. 22, for example, the first region 415*a* and the second region 415*b* are divided by a dashed-dotted line that extends in the horizontal direction. The first region 415*a* may support the second tray 380.

The controller to be described later may control the second ice maker to allow the second pusher 540 to move from a first point outside the ice-making cell 320*a* to a second point inside the second tray supporter 400 via the lower opening 406*b*. A deformation resistance degree of the second tray supporter 400 may be greater than that of the second tray 380. A restoration degree of the second tray supporter 400 may be less than that of the second tray 380.

In another aspect, the second tray supporter 400 includes a first region 415*a* including a lower opening 406*b* and a second region 415*b* disposed farther from the transparent ice heater 430 than the first region 415*a*.

Figure 25:
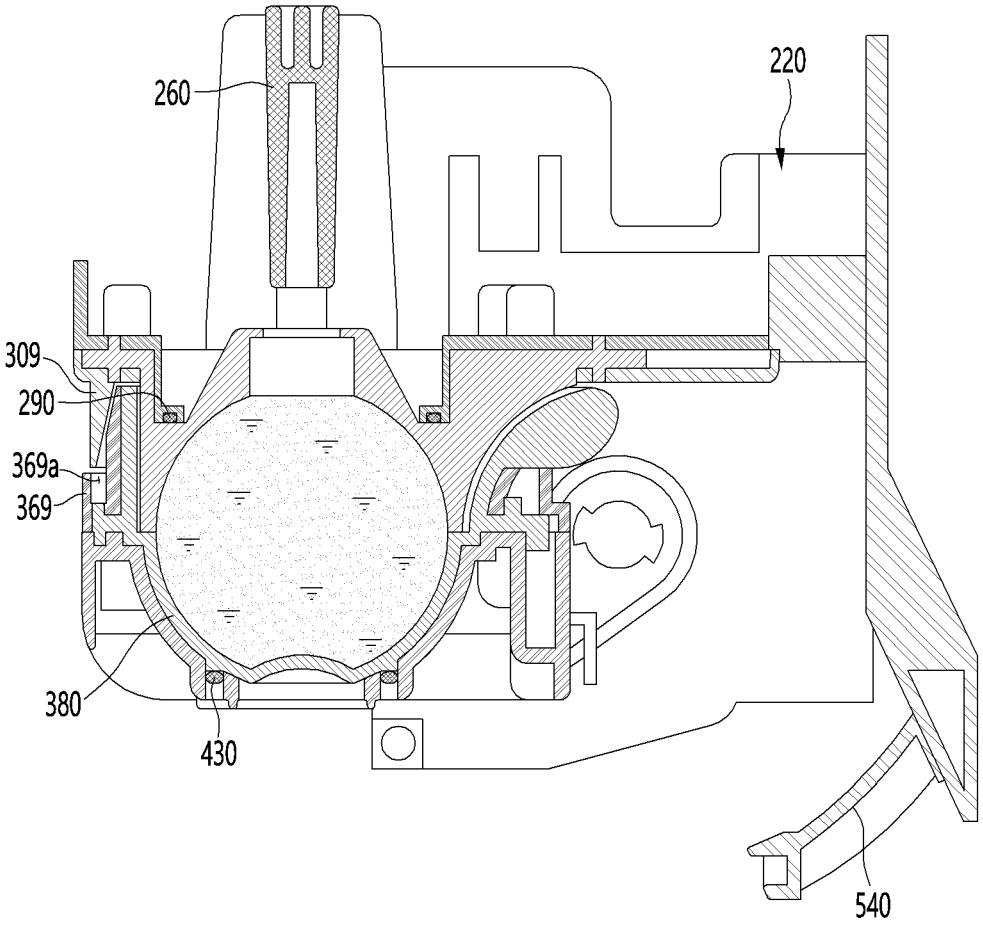
FIG. 25 is a cross-sectional view taken along line 25-25 of FIG. 6.
Figure 26:
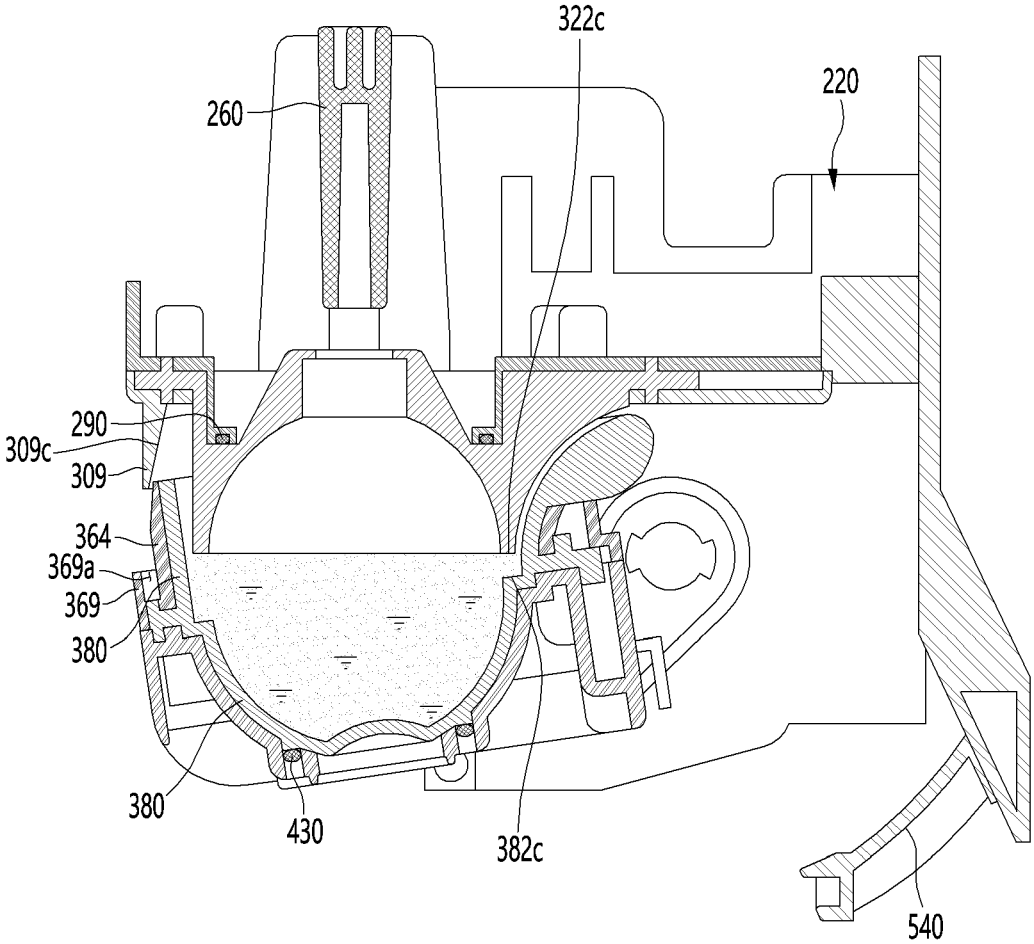
FIG. 26 is a view illustrating a state in which a second tray moves to a water supply position in FIG. 25.
Figure 27:
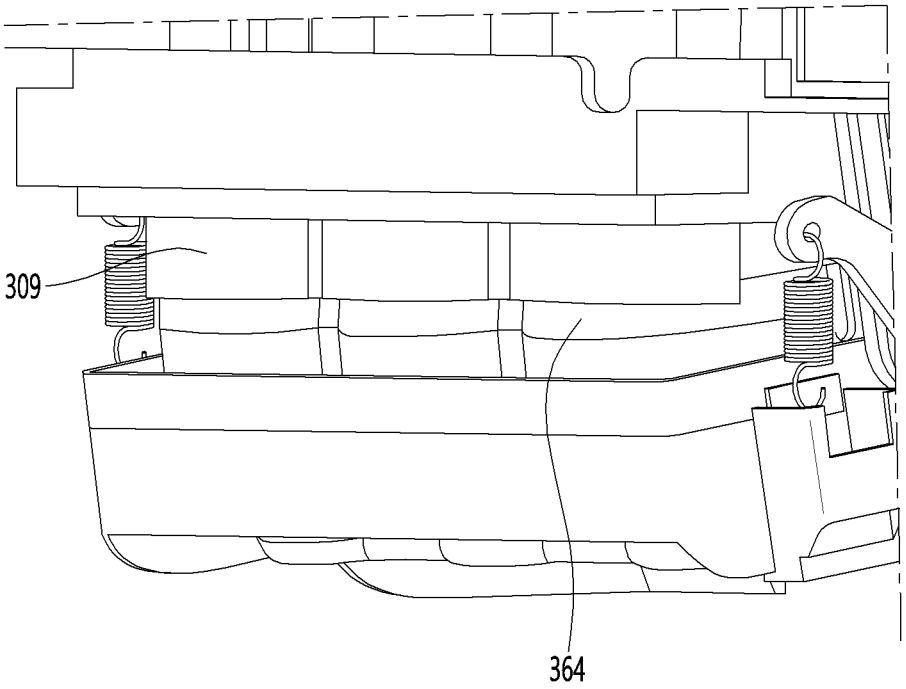
FIG. 27 is a view of a water overflow prevention wall in a state in which the second tray moves to the water supply position.

FIG. 25 is a cross-sectional view taken along line 25-25 of FIG. 6, and FIG. 26 is a view illustrating a state in which the second tray moves to the water supply position in FIG. 25. FIG. 27 is a view of the water overflow prevention wall in a state in which the second tray moves to the water supply position.

Referring to FIGS. 25 to 27, the second ice maker 200 according to the present embodiment may be designed so that a position of the second tray 380 is different from the water supply position and the ice-making position.

In FIG. 26, as an example, a water supply position of the second tray 380 is illustrated. For example, in the water supply position as illustrated in FIG. 26, at least a portion of a first contact surface 322*c* of the first tray 320 and a second contact surface 382*c* of the second tray 380 may be spaced apart from each other.

In FIG. 26, for example, a shape in which the entire first contact surface 322*c* is spaced apart from the entire second contact surface 382*c*. Thus, at the water supply position, the first contact surface 322*c* may be inclined at a predetermined angle with respect to the second contact surface 382*c*.

Although not limited thereto, at the water supply position, the first contact surface 322*c* may be substantially maintained horizontally, and the second contact surface 382*c* may be disposed to be inclined with respect to the first contact surface 322*c* under the first tray 320.

A portion of the second tray 380 may be spaced apart from the first tray 320 at the water supply position. For example, a second portion 383 of the second tray 380 may be spaced apart from the first tray 320 in the horizontal direction. Thus, a gap may exist between the second portion 383 of the second tray 380 and the first tray 320.

The water supply portion 240 may supply water to one opening of the plurality of openings 324. In this case, the water supplied through the one opening 324 falls to the second tray 380 after passing through the first tray 320. In the water supply process, water may fall into any one second cell 381*a* of the plurality of second cells 381*a* of the second tray 380. The water supplied to any one second cell 361*a* may overflow from any one second cell 381*a*.

In the present embodiment, since the second contact surface 382*c* of the second tray 380 is spaced apart from the first contact surface 322*c* of the first tray 320, the water overflowed from any one second cells 381*a* may move to the other adjacent second cell 381*c* along the second contact surface 382*c* of the second tray 380. Therefore, the plurality of second cells 381*a* the second tray 380 may be filled with water.

Also, in the state in which water supply is completed, a portion of the water supplied may be filled in the second cell 381*a*, and the other portion of the water supplied may be filled in the space between the first tray 320 and the second tray 380.

When the second tray 380 move from the water supply position to the ice-making position as being illustrated in FIG. 25, the water in the space between the first tray 320 and the second tray 380 may be uniformly distributed to the plurality of first cells 321*a*.

When the second tray 380 is at the water supply position, a portion of the second tray 380 may be disposed between the water overflow prevention wall 309 and the first tray 380 to prevent water of the ice-making cell 320*a* from overflowing to the outside through a gap between the first tray 320 and the second tray 380 by opening and closing of the refrigerating compartment door 10 or vibration of the refrigerator 1 at the water supply position of the second tray 380.

For example, a lower end of the water overflow prevention wall 309 may be disposed lower than an upper end of the second tray 380. Thus, at the water supply position of the second tray 380, the water passing through the gap between the first tray 320 and the second tray 380 may collide with the water overflow prevention wall 309 and thus may be discharged to the outside. The water colliding with the water overflow prevention wall 309 may be introduced into the gap between the first tray 320 and the second tray 380 again.

A gap may exist between the water overflow prevention wall 309 and the second tray 380 (substantially the second tray cover). Even if water flows to the outside through the gap between the water overflow prevention wall 309 and the second tray 380 (substantially the second tray cover), since the water flows along an outer surface of the second tray cover 360 and then is accommodated in the water accommodation chamber 369*a*, the water may be prevented from dropping into the second ice bin 600.

At the water supply position, the chamber wall 369 may be disposed farther from a center of the first ice-making cell 321*a* than the water overflow prevention wall 309. The water overflow prevention wall 309 may be vertically aligned with the water accommodation chamber 369*a*.

At the ice-making position, the water overflow prevention wall 309 may be disposed higher than the chamber wall 369, but may be disposed adjacent to the chamber wall 369. A bottom surface of the water overflow prevention wall 309 may be disposed to face the water accommodation chamber 369*a*. The water overflow prevention wall 309 may be vertically aligned with the water accommodation chamber 369*a*. The water overflow prevention wall 309 may cover the water accommodation chamber 369*a*. Even if water exists in the water accommodation chamber 369*a*, the water overflow prevention wall 309 may restrict the overflow of the water in the water accommodation chamber 369*a* from the water accommodation chamber 369*a*.

At the ice-making position, the second contact surface 382*c* may be in contact with at least a portion of the first contact surface 322*c*. The angle defined by the second contact surface 382*c* of the second tray 380 and the first contact surface 322*c* of the first tray 320 at the ice-making position is less than that defined by the second contact surface 382*c* of the second tray 380 and the first contact surface 322*c* of the first tray 320 at the water supply position. At the ice-making position, the entire first contact surface 322*c* may be in contact with the second contact surface 382*c*. At the ice-making position, the second contact surface 382*c* and the first contact surface 322*c* may be disposed to be substantially horizontal. In the present embodiment, the water supply position of the second tray 380 and the ice-making position are different from each other. This is done for uniformly distributing the water to the plurality of ice-making cells 320*a* without providing a water passage for the first tray 320 and/or the second tray 380 when the ice maker 200 includes the plurality of ice-making cells 320*a*.

In order to prevent the water overflow prevention wall 309 from interfering with the second tray cover 360 during the rotation of the second tray from the water supply position to the ice-making position, the water overflow prevention wall 309 may include an inclined surface 309*c*. The inclined surface 309*c* may be a surface facing the first tray 320, i.e., at least a portion of the inclined surface may be inclined downward in a direction away from the first tray 320, The inclined surface 369*a*2 of the first chamber wall 364*a* of the second tray cover 360 may be disposed to face the inclined surface 309*c*.

Figure 28:
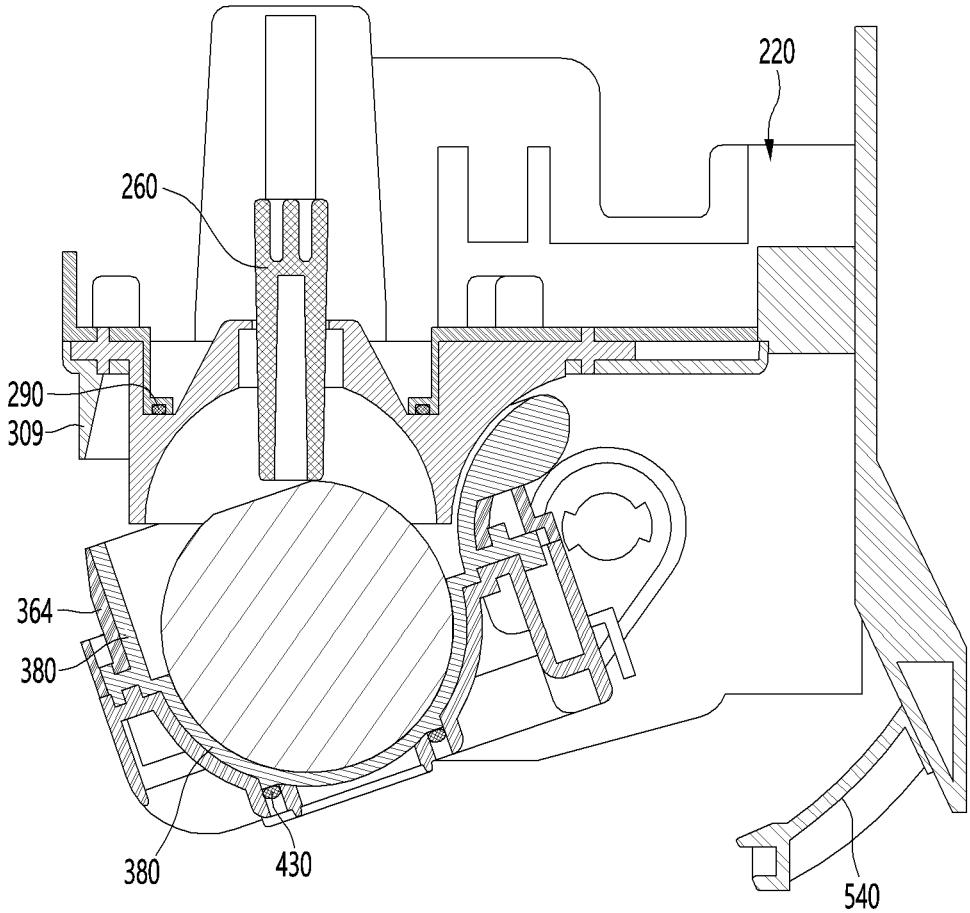
FIG. 28 is a view illustrating a state before the second tray moves to an ice-making position.
Figure 29:
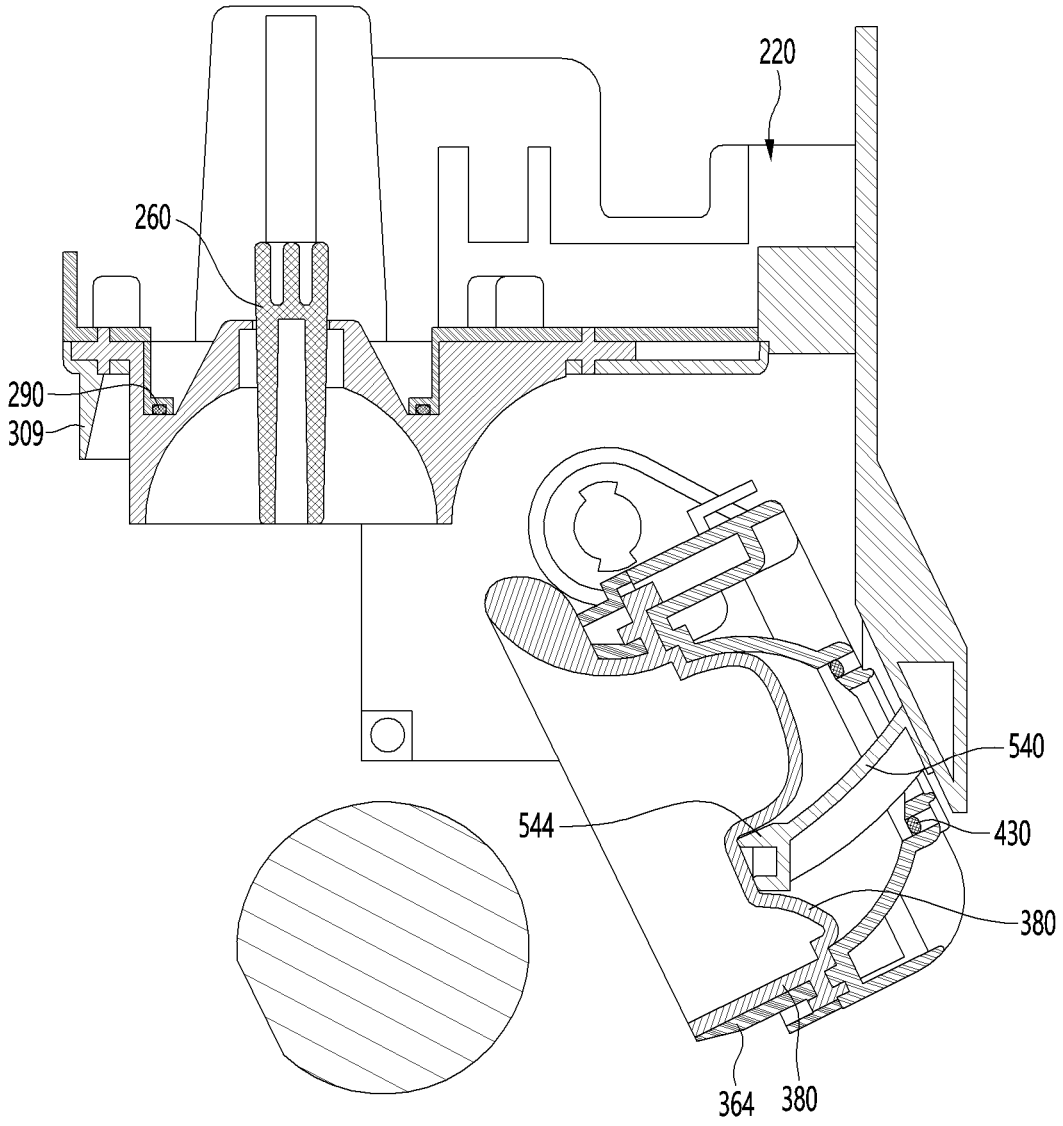
FIG. 29 is a view illustrating a state in which the second tray moves to an ice-separation position in the ice separation process.

FIG. 28 is a view illustrating a state before the second tray moves to the ice-making position, and FIG. 29 is a view illustrating a state in which the second tray moves to the ice-separation position in the ice separation process.

Referring to FIGS. 25 to 29, in order to make ice in the second ice maker 200, a controller (not shown) allows the second tray 380 to move to the water supply position.

In this specification, a direction in which the second tray 380 moves from the ice-making position of FIG. 23 to the ice-separation position of FIG. 29 may be referred to as forward movement (or forward rotation). On the other hand, the direction from the ice-separation position of FIG. 29 to the water supply position of FIG. 26 may be referred to as reverse movement (or reverse rotation).

The movement to the water supply position of the second tray 380 is detected by a sensor, and when it is detected that the second tray 380 moves to the water supply position, the controller stops the driving portion 480.

In the state in which the second tray 380 moves to the water supply position, the water supply starts. In order to supply water, when it is determined that a set amount of water has been supplied after turning on the water supply valve, the controller may turn off the water supply valve.

For example, in the process of supplying water, when a pulse is outputted from a flow sensor, and the outputted pulse reaches a reference pulse, it may be determined that a predetermined amount of water is supplied.

After the water supply is completed, the controller controls the driving portion 480 to allow the second tray 380 to move to the ice-making position. For example, the controller may control the driving portion 480 to allow the second tray 380 to move from the water supply position in the reverse direction. When the second tray 380 move in the reverse direction, the second contact surface 382*c* of the second tray 380 comes close to the first contact surface 322*c* of the first tray 320. Then, water between the second contact surface 382*c* of the second tray 380 and the second contact surface 322*c* of the first tray 320 is divided into each of the plurality of second cells 381*a* and then is distributed. When the second contact surface 382*c* of the second tray 380 and the first contact surface 322*c* of the first tray 320 contact each other, water is filled in the first cell 321*a*.

The movement to the ice-making position of the second tray 380 is detected by a sensor, and when it is detected that the second tray 380 moves to the ice-making position, the controller stops the driving portion 480.

In the state in which the second tray 380 moves to the ice-making position, ice making starts. For example, the ice making may be started when the second tray 380 reaches the ice-making position. Alternatively, when the second tray 380 reaches the ice-making position, and the water supply time elapses, the ice making may be started. When the ice making starts, the water in the ice-making cell 320*a* may be cooled by the cold air supplied to the ice-making cell 320*a*.

The controller may control the transparent ice heater 430 to be turned on in at least a partial section during the ice-making process. When the transparent ice heater 430 is turned on, since the heat of the transparent ice heater 430 is transferred to the ice-making cell 320*a*, the ice making rate of the ice-making cell 320*a* may be delayed.

According to the present embodiment, the ice making rate may be delayed so that the bubbles dissolved in the water inside the ice-making cell 320*a* move from the portion at which ice is made toward the liquid water by the heat of the transparent ice heater 430 to make the transparent ice in the second ice maker 200.

In the ice making process, the controller may determine whether the turn-on condition of the transparent ice heater 430 is satisfied. In the present embodiment, the transparent ice heater 430 is not turned on immediately after the ice making is started, and the transparent ice heater 430 may be turned on only when the turn-on condition of the transparent ice heater 430 is satisfied. Generally, the water supplied to the ice-making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In the present embodiment, the transparent ice heater 430 may not be turned on until the water is phase-changed into ice. If the transparent ice heater 430 is turned on before the temperature of the water supplied to the ice-making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice-making cell 320*a* before the ice is made, the transparent ice heater 430 may operate regardless of the transparency of the ice. Thus, according to the present embodiment, after the turn-on condition of the transparent ice heater 430 is satisfied, when the transparent ice heater 430 is turned on, power consumption due to the unnecessary operation of the transparent ice heater 430 may be prevented. Alternatively, even if the transparent ice heater 430 is turned on immediately after the start of ice making, since the transparency is not affected, it is also possible to turn on the transparent ice heater 430 after the start of the ice making.

In the present embodiment, the controller may determine that the turn-on condition of the transparent ice heater 430 is satisfied when a predetermined time elapses from the set specific time point. The specific time point may be set to at least one of the time points before the transparent ice heater 430 is turned on.

Alternatively, the controller determines that the turn-on condition of the transparent ice heater 430 is satisfied when a temperature detected by the temperature sensor 700 reaches a turn-on reference temperature. For example, the turn-on reference temperature may be a temperature for determining that water starts to freeze at the uppermost side (side of the opening) of the ice-making cell 320*a*. When a portion of the water is frozen in the ice-making cell 320*a*, the temperature of the ice in the ice-making cell 320*a* is below zero. The temperature of the first tray 320 may be higher than the temperature of the ice in the ice-making cell 320*a*. Alternatively, although water exists in the ice-making cell 320*a*, after the ice starts to be made in the ice-making cell 320*a*, the temperature detected by the temperature sensor 700 may be below zero.

Thus, to determine that making of ice is started in the ice-making cell 320*a* on the basis of the temperature detected by the temperature sensor 700, the turn-on reference temperature may be set to the below-zero temperature. That is, when the temperature sensed by the temperature sensor 700 reaches the turn-on reference temperature, since the turn-on reference temperature is below zero, the ice temperature of the ice-making cell 320*a* is below zero, i.e., lower than the below reference temperature. Therefore, it may be indirectly determined that ice is made in the ice-making cell 320*a*.

As described above, when the transparent ice heater 430 is not used, the heat of the transparent ice heater 430 is transferred into the ice-making cell 320*a*. In the present embodiment, when the second tray 380 is disposed below the first tray 320, the transparent ice heater 430 is disposed to supply the heat to the second tray 380, the ice may be made from an upper side of the ice-making cell 320*a*.

In the present embodiment, since ice is made from the upper side in the ice-making cell 320*a*, the bubbles move downward from the portion at which the ice is made in the ice-making cell 320*a* toward the liquid water. Since density of water is greater than that of ice, water or bubbles may be convex in the ice-making cell 320*a*, and the bubbles may move to the transparent ice heater 430. In the present embodiment, the mass (or volume) per unit height of water in the ice-making cell 320*a* may be the same or different according to the shape of the ice-making cell 320*a*.

In the present embodiment, the controller may control a heating amount of the transparent ice heater 430 to be variable according to the mass per unit height of the water in the ice-making cell 320*a*.

In the present specification, the variation in the heating amount of the transparent ice heater 430 may represent varying the output of the transparent ice heater 430 or varying the duty of the transparent ice heater 430. In this case, the duty of the transparent ice heater 430 represents a ratio of the turn-on time and the turn-off time of the transparent ice heater 430 in one cycle, or a ratio of the turn-on time and the turn-off time of the transparent ice heater 430 in one cycle.

The controller may determine whether the ice-making is completed based on the temperature detected by the temperature sensor 700. When it is determined that the ice making is completed, the controller may turn off the transparent ice heater 430.

For example, when the temperature sensed by the temperature sensor 700 reaches a first reference temperature, the controller may determine that the ice making is completed to turn off the transparent ice heater 430.

In this case, since a distance between the temperature sensor 700 and each ice-making cell 320*a* is different, in order to determine that the ice making is completed in all the ice-making cells 320*a*, the controller may perform the ice separation after a certain amount of time, at which it is determined that ice making is completed, has passed or when the temperature detected by the temperature sensor 700 reaches a second reference temperature lower than the first reference temperature.

When the ice making is completed, the controller operates one or more of the ice maker heater 290 and the transparent ice heater 430.

When at least one of the ice heater 290 or the transparent ice heater 430 is turned on, heat of the heater is transferred to at least one of the first tray 320 or the second tray 380 so that the ice may be separated from the surfaces (inner surfaces) of one or more of the first tray 320 and the second tray 380.

Also, the heat of the heaters 290 and 430 is transferred to the contact surface of the first tray 320 and the second tray 380, and thus, the first contact surface 322*c* of the first tray 320 and the second contact surface 382*c* of the second tray 380 may be in a state capable of being separated from each other.

When at least one of the ice separation heater 290 and the transparent ice heater 430 operate for a predetermined time, or when the temperature sensed by the temperature sensor 700 is equal to or higher than an off reference temperature, the controller is turned off the heaters 290 and 430, which are turned on. Although not limited, the turn-off reference temperature may be set to below zero temperature.

The controller operates the driving portion 480 to allow the second tray 380 to move in the forward direction. As illustrated in FIG. 28, when the second tray 380 move in the forward direction, the second tray 380 is spaced apart from the first tray 320.

The moving force of the second tray 380 is transmitted to the first pusher 260 by the pusher link 500. Then, the first pusher 260 descends along the guide slot 307, and thus, the pushing bar 264 passes through the blocking wall 325*b* and the opening 324 to press the ice within the ice-making cell 320*a*.

In the present embodiment, the ice may be separated from the first tray 320 before the pushing bar 264 presses the ice in the ice making process. That is, ice may be separated from the surface of the first tray 320 by the heater that is turned on. In this case, the ice may move together with the second tray 380 while the ice is supported by the second tray 380. For another example, even when the heat of the heater is applied to the first tray 320, the ice may not be separated from the surface of the first tray 320. Therefore, when the second tray 380 moves in the forward direction, there is possibility that the ice is separated from the second tray 380 in a state in which the ice contacts the first tray 320. In this state, while the second tray 380 moves, the pushing bar 264 passing through the opening 324 may press the ice contacting the first tray 320 to separate the ice from the first tray 320. The ice separated from the first tray 320 may be supported again by the second tray 380.

When the ice moves together with the second tray 380 while the ice is supported by the second tray 380, the ice may be separated from the tray 250 by its own weight even if no external force is applied to the second tray 380.

While the second tray 380 moves, even if the ice does not drop from the second tray 380 by its own weight, when the second tray 380 is pressed by the second pusher 540 as illustrated in FIG. 29, the ice may be separated from the second tray 380 to drop downward.

Particularly, as illustrated in FIG. 29, while the second tray 380 moves, the second tray 380 may be in contact with the pushing bar 544 of the second pusher 540. When the second tray 380 continuously moves in the forward direction, the pushing bar 544 may press the second tray 380 to deform the second tray 380. Thus, the pressing force of the pushing bar 544 may be transferred to the ice so that the ice is separated from the surface of the second tray 380. The ice separated from the surface of the second tray 380 may drop downward and be stored in the second ice bin 600. The position of the second tray 380 in FIG. 29 is the ice-separation position.

After the ice is separated from the second tray 380, the controller controls the driving portion 480 to allow the second tray 380 to move in the reverse direction.

Then, the second tray 380 moves from the ice-separation position to the water supply position. When the second tray 380 moves to the water supply position of FIG. 26, the controller stops the driving portion 480. When the second tray 380 is spaced apart from the pushing bar 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the pushing bar 264 is removed from the ice-making cell 320*a*.

Optionally or additionally, the refrigerator according to the present embodiment may further include a door open detection portion for detecting an opening of the refrigerating compartment door 10.

When the opening of the refrigerating compartment door 10 is detected by the door open detection portion in a state in which the second tray 380 is disposed at the water supply position, the controller may control the second tray 380 to move from the water supply position to the ice-making position.

When the refrigerating chamber door 10 is opened during the water supply process, if it is detected that the refrigerator door 10 is closed, the second tray 380 may move again to the water supply position, and then, the water supply process may restart.

In the above embodiment, it should be noted that the structure for preventing the water overflow (water overflow prevention wall 309) or the structure for preventing the overflow water from dropping into the ice bin (chamber wall 369) is equally applied even when the second ice maker 200 is provided in the freezing compartment or the refrigerating compartment rather than the refrigerator door.

Also, the second ice maker 200 may include only one of the water overflow prevention wall 309 and the chamber wall 369. That is, the second ice maker 200 may include only the water overflow prevention wall 309, or the second ice maker 200 may include only the chamber wall 369.

When the second ice maker 200 includes only the chamber wall 369, even if water in the ice-making cell 320*a* overflows, the overflowing water may flow toward the water accommodation chamber 369*a* along the inclined surface 364*a*2 and then be accommodated in the water accommodation chamber 369*a*. Even if the water stored in the water accommodation chamber 369*a* is frozen, the ice in the water accommodation chamber 369*a* has no effect on the ice making or ice separation process of the second ice maker 200.

Also, when the second ice maker 200 includes only the chamber wall 369, the blocking wall 325*b* may also be omitted.

In the above embodiment, it is noted that the remaining structure of the ice maker except for the structure for preventing the water overflow or the structure for preventing the overflowing water from dropping into the ice bin are provided as an example and thus modified from the structure described above, and also, omission, change, additional combinations, etc., of the components are possible.

The invention claimed is:

1. A refrigerator, comprising:

a cabinet configured to provide a storage compartment;

a door configured to open and close the storage compartment; and an ice maker disposed in the storage compartment or at the door to provide ice, wherein the ice maker comprises:

a first tray configured to define a first portion of an ice-making cell;

a first tray case configured to support the first tray;

a second tray configured to define a second portion of the ice-making cell, and to move with respect to the first tray; and a second tray case configured to support the second tray, wherein, after supply of water to the ice-making cell while the second tray is at a water supply position, the second tray is to move in a first direction to an ice-making position, after generation of the ice while the second tray is at the ice-making position, the second tray is to move in a second direction so as to draw the ice out of the ice-making cell, and then the second tray is to move in the first direction to the water supply position, wherein at the water supply position, the second tray is spaced from a portion of the first tray, and the first tray case includes a water overflow prevention wall configured to surround part of the first tray by being spaced apart from the first tray when the second tray is disposed at the water supply position, and wherein based on the second tray disposed at the water supply position, a portion of the second tray is disposed between the water overflow prevention wall and the first tray.

2. The refrigerator according to claim 1, wherein based on the second tray disposed at the water supply position, a lower part of the water overflow prevention wall is disposed higher than an upper part of the second tray.

3. The refrigerator according to claim 2, wherein the water overflow prevention wall includes an inclined surface that faces the first tray, wherein the inclined surface is inclined downward in a direction away from the first tray.

4. The refrigerator according to claim 1, wherein the second tray case includes a chamber wall configured to define a water accommodation chamber to accommodate water overflowing from the ice-making cell, and the water accommodation chamber is vertically aligned with the water overflow prevention wall when the second tray is disposed at the water supply position.

5. The refrigerator according to claim 1, wherein the first tray includes:

an opening configured to communicate with the ice-making cell;

a storage compartment wall to extend upward from the opening; and a blocking wall disposed at an upper part of the storage compartment wall.

6. The refrigerator according to claim 5, comprising a pusher having a pushing bar configured to pass through the opening so as to separate the ice from the first tray, wherein the blocking wall includes a through-hole through which the pushing bar is to pass.

7. The refrigerator according to claim 6, wherein the blocking wall is made of a deformable material, and a diameter of the through-hole is less than a diameter of the pushing bar, or the blocking wall includes a plurality of slits to extend in a radial direction from the through-hole.

8. The refrigerator according to claim 1, wherein the tray case includes a plate coupled to or in contact with the first tray, and the water overflow prevention wall extends from the plate.

9. A refrigerator, comprising:

a cabinet having a storage compartment;

a door configured to open and close the storage compartment; and an ice maker disposed in the storage compartment or at the door to provide ice, wherein the ice maker comprises:

a first tray configured to define a first portion of an ice-making cell;

a second tray configured to define a second portion of the ice-making cell, and a portion of the second tray is configured to surround part of the first tray; and a tray case configured to support the second tray, wherein the tray case includes a chamber wall configured to define a water accommodation chamber to accommodate water overflowing from the ice-making cell through a gap between the first tray and the second tray.

10. The refrigerator according to claim 9, wherein the tray case includes a cover wall configured to surround part of the second tray, and the cover wall is configured to define the water accommodation chamber along with the chamber wall.

11. The refrigerator according to claim 10, wherein the cover wall includes:

a first cover wall; and a second cover wall disposed closer to a rotation center of the second tray than the first cover wall, wherein the chamber wall is connected to the first cover wall.

12. The refrigerator according to claim 11, wherein the chamber wall includes:

a first chamber wall spaced away from the first cover wall; and second and third chamber walls configured to extend from both ends of the first chamber wall in a direction crossing the first chamber wall and connected to the first cover wall.

13. The refrigerator according to claim 12, wherein a portion of the first cover wall is rounded in a horizontal direction, and the chamber wall has a height greater than a minimum distance between the first cover wall and the first chamber wall.

14. The refrigerator according to claim 11, wherein a height of the first cover wall is greater than a height of the chamber wall.

15. The refrigerator according to claim 11, wherein the first cover wall includes:

a vertical surface; and an inclined surface that is inclined from an upper part of the vertical surface, wherein the inclined surface is inclined upward in a direction away from the first cover wall.

16. The refrigerator according to claim 10, comprising an additional tray case configured to support the first tray, wherein the additional tray case includes a barrier configured to cover part of the first tray by being spaced apart from an outside of the first tray, and an upper part of the cover wall is disposed between the barrier and the second tray when the second tray is at a water supply position.

17. A refrigerator, comprising:

a door configured to open and close a storage compartment; and an ice maker to provide ice, wherein the ice maker comprises:

a tray configured to define a portion of an ice-making cell; and a tray case that includes a plate coupled to or in contact with the tray and a water overflow prevention wall that extends from the plate and configured to surround a part of the tray by being spaced apart from the tray.

18. The refrigerator of claim 17, wherein the tray includes a first tray configured to define a first portion of an ice-making cell, and a second tray configured to define a second portion of the ice-making cell, and wherein the water overflow prevention wall is configured to surround a part of the first tray.

19. The refrigerator of claim 18, wherein the tray case includes an opening through which the first tray passes, and the water overflow prevention wall is spaced apart from the plate opening.

* * * * *